US007328178B2

(12) United States Patent
Matsumoto et al.

(10) Patent No.: US 7,328,178 B2
(45) Date of Patent: Feb. 5, 2008

(54) CONTENT BILLING METHOD, AND CONTENT BILLING SYSTEM AND CONTENT BILLING APPARATUS USING THE CONTENT BILLING METHOD

(75) Inventors: Shuichi Matsumoto, Tokyo (JP); Kazuhiro Naito, Tokyo (JP); Hirokazu Sugiyama, Tokyo (JP); Azumi Yoshida, Tokyo (JP); Toshihiko Oda, Tokyo (JP)

(73) Assignee: Fujitsu Limited, Kawasaki (JP)

( * ) Notice: Subject to any disclaimer, the term of this patent is extended or adjusted under 35 U.S.C. 154(b) by 840 days.

(21) Appl. No.: 10/320,519

(22) Filed: Dec. 17, 2002

(65) Prior Publication Data

US 2003/0187760 A1 Oct. 2, 2003

(30) Foreign Application Priority Data

Mar. 27, 2002 (JP) ..... 2002-089056

(51) Int. Cl.
*G07F 19/00* (2006.01)

(52) U.S. Cl. ..... 705/34

(58) Field of Classification Search ..... 705/34, 705/52, 26, 51, 1; 713/182–186
See application file for complete search history.

(56) References Cited

U.S. PATENT DOCUMENTS 6,389,403 B1 * 5/2002 Dorak, Jr. ..... 705/52
6,587,837 B1 * 7/2003 Spagna et al. ..... 705/26
6,834,110 B1 * 12/2004 Marconcini et al. ..... 380/239

FOREIGN PATENT DOCUMENTS

JP 11-66009 3/1999
JP 2000-330873 11/2000
JP 2001-344314 12/2001

OTHER PUBLICATIONS

Patent Abstract of Japan dated Oct. 24, 2000, Publication No. 2000-298689.
Patent Abstract of Japan dated Nov. 30, 2000, Publication No. 2000-330873.
Masaji Kawahara et al., "An Overview of Superdistribution Technology", IPSJ Technical Reports Information Processing Society of Japan, Sep. 19, 1998 vol. 98, No. 85 pp. 9-14 (copy already filed with Jul. 12, 2007 IDS).

(Continued)

*Primary Examiner*—Ronald Laneau
(74) *Attorney, Agent, or Firm*—Staas & Halsey LLP

(57) ABSTRACT

A content billing method for performing billing processing corresponding to use of digital content. After the operation is started, search management processing is performed. In the search management processing, information on whether or not a search period expires is managed. When the search period expires, content is searched for in automatic-search-and-collection processing, and identification information of the content is extracted and use information is generated in identification-information recognition processing. The use information is recorded and managed in use-information management processing. Subsequently, in state-of-use recognition processing, a status of use in a predetermined period is recognized based on the use information, and state-of-use information is generated. Finally, in use-fee calculation processing, a use fee corresponding to the state-of-use information is calculated.

9 Claims, 24 Drawing Sheets

OTHER PUBLICATIONS

Partial translation of Japanese Office Action dated Jul. 10, 2007 issued in published application JP 2002-089056.
Japanese Office Action dated Jul. 10, 2007 in corresponding application No. 2002-089056 (In Japanese) (3pp).
"An Overview of Superdistribution Technology," Masaji Kawahara et al., dated Sep. 19, 1998, pp. 9-11 and 13. (In Japanese mostly).
Patent Abstracts of Japan dated Mar. 9, 1999, Publication No.: 11-065009.
Patent Abstracts of Japan dated Nov. 30, 2000, Publication No.: 2000-330873.
Patent Abstracts of Japan dated Dec. 14, 2001, Publication No.: 2001-344314.

* cited by examiner

2162 SEARCH-PERIOD FILE

SEARCH MODE=[FIXED TIME | RANDOM]

SEARCH PERIOD= 【MINUTE】【HOUR】【DAY】
【MONTH】【DAY OF THE WEEK】

FIG. 4 (A)

【EXAMPLE 1】 EXECUTE ON 31ST OF EVERY MONTH AT 16:00

SEARCH MODE=FIXED TIME

SEARCH PERIOD=0 16 31 * *

FIG. 4 (B)

【EXAMPLE 2】 EXECUTE ON EVERY FRIDAY AT 0:30

SEARCH MODE=FIXED TIME

SEARCH PERIOD=30 0 * * FRIDAY

FIG. 4 (C)

2161 SEARCH-DESTINATION FILE

[NETWORK]

NETWORK ADDRESS 1

NETWORK ADDRESS 2

NETWORK ADDRESS 3

:

[HOST]

HOST ADDRESS 1

HOST ADDRESS 2

HOST ADDRESS 3

:

FIG. 5

2164a USE-INFORMATION FILE

DATE AND TIME OF REPORT PRODUCTION: 2002/10/05 CUSTOMER ID:A123

| PATH NAME | FILE NAME | CONTENT ID | SALES CONTROL NUMBER |
|---|---|---|---|
| ¥¥User1¥images¥ | photo_a.jpg | P00001 | 0209151318-0001 |
| ¥¥User2¥images¥ | photo_a.jpg | P00001 | 0209151318-0001 |
| ¥¥User1¥images¥ | photo_b.jpg | P00002 | 0210041530-0003 |

2164-1 2164-2 2164-3 2164-4

FIG. 10

1120 USE-INFORMATION DATABASE

| CUSTOMER CODE | DATE AND TIME OF SEARCH | CONTENT ID | SALES CONTROL NUMBER | PATH NAME | FILE NAME | |
|---|---|---|---|---|---|---|
| | | | | | | |
| A123 | 2002/10/1:00:00 | P00001 | 0209151318-0001 | ¥¥User1images¥ | photo_a.jpg | |
| A123 | 2002/10/2:00:00 | P00001 | 0209151318-0001 | ¥¥User1images¥ | photo_a.jpg | |
| : | : | : | : | : | : | |
| A123 | 2002/11/1:00:00 | P00001 | 0209151318-0001 | ¥¥User1images¥ | photo_a.jpg | |
| A123 | 2002/11/2:00:00 | P00001 | 0209151318-0001 | ¥¥User1images¥ | photo_a.jpg | |
| : | : | : | : | : | : | |
| A123 | 2002/12/1:00:00 | P00001 | 0209151318-0001 | ¥¥User1images¥ | photo_a.jpg | |
| A123 | 2002/10/20:00:00 | P00001 | 0209151318-0001 | ¥¥User2images¥ | photo_a.jpg | |
| : | : | : | : | : | : | |
| A123 | 2002/11/1:00:00 | P00001 | 0209151318-0001 | ¥¥User2images¥ | photo_a.jpg | |
| : | : | : | : | : | : | |
| A123 | 2002/12/1:00:00 | P00001 | 0209151318-0001 | ¥¥User2images¥ | photo_a.jpg | |
| : | : | : | : | : | : | |
| A123 | 2002/10/5:00:00 | P00002 | 0210041530-0003 | ¥¥User1images¥ | photo_b.jpg | |
| : | : | : | : | : | : | |
| A123 | 2002/10/20:00:00 | P00002 | 0210041530-0003 | ¥¥User1images¥ | photo_b.jpg | |
| | | | | | | |

FIG. 11

1162-1 STATUS-OF-USE FILE

| CUSTOMER ID | DATE AND TIME OF BILLING | CONTENT ID | SALES CONTROL NUMBER | PATH NAME | FILE NAME | STATUS OF PROCESSING | |
|---|---|---|---|---|---|---|---|
| | | | | | | | |
| | | | | | | | |
| A123 | 2002/11 | P00001 | 0209151318-0001 | ¥¥User2¥images¥ | photo_a.jpg | COMPLETED | |
| A123 | 2002/11 | P00002 | 0210041530-0003 | ¥¥User1¥images¥ | photo_b.jpg | COMPLETED | ● ● ● ● |
| A123 | 2002/12 | P00003 | 0211121034-0005 | ¥¥User3¥images¥ | photo_c.jpg | NOT YET PROCESSED | |
| | | | | | | | |
| | | | | | | | |

ITEMS BILLED IN NOVEMBER

ITEM BILLED IN DECEMBER

FIG. 14

1162−2 STATUS-OF-USE FILE

| CUSTOMER ID | DATE AND TIME OF BILLING | CONTENT ID | SALES CONTROL NUMBER | PATH NAME | FILE NAME | CUMULATIVE NUMBER OF MONTHS IN WHICH THE CONTENT IS USED | STATUS OF PROCESSING | |
|---|---|---|---|---|---|---|---|---|
| | | | | | | | | |
| | | | | | | | | |
| A123 | 2002/11 | P00001 | 0209151318 − 0001 | ¥¥ User1 ¥ images ¥ | photo_a .jpg | 5 | COMPLETED | |
| A123 | 2002/12 | P00001 | 0209151318 − 0001 | ¥¥ User1 ¥ images ¥ | photo_a .jpg | 6 | NOT YET PROCESSED | ● ● ● ● |
| A123 | 2002/12 | P00001 | 0209151318 − 0001 | ¥¥ User2 ¥ images ¥ | photo_a .jpg | 6 | NOT YET PROCESSED | |
| | | | | | | | | |
| | | | | | | | | |

ITEM BILLED IN NOVEMBER

ITEMS BILLED IN DECEMBER

FIG. 17

1163 FEE TABLE

| CONTENT ID | COMMODITY NAME | UNIT PRICE |
|---|---|---|
| P00001 | PORTRAIT A | 100 |
| P00002 | PORTRAIT B | 100 |
| P00003 | PORTRAIT C | 100 |
| P00004 | LANDSCAPE (PYRAMID) | 200 |
| P00005 | LANDSCAPE (SPHINX) | 200 |
| P00006 | LANDSCAPE (MT. FUJI) | 200 |

FIG. 18

1166 BILLING TABLE

| CUSTOMER ID | YEAR AND MONTH OF BILLING | COMMODITY CODE | COMMODITY NAME | BILLED AMOUNT | |
|---|---|---|---|---|---|
| A123 | 2002/11 | P00001 | PORTRAIT A | 100 | |
| A123 | 2002/11 | P00002 | PORTRAIT B | 100 | ●●●● |
| A123 | 2002/12 | P00003 | PORTRAIT C | 100 | |
| | | | | | |

FIG. 24

CONTENT BILLING METHOD, AND CONTENT BILLING SYSTEM AND CONTENT BILLING APPARATUS USING THE CONTENT BILLING METHOD

BACKGROUND OF THE INVENTION

1) Field of the Invention

The present invention relates to a content billing method, and a content billing system and a content billing apparatus using the content billing method. In particular, the present invention relates to a content billing method for performing billing processing for digital content in which identification information is embedded by using a digital (electronic) watermarking technique on a computer, and a content billing system and a content billing apparatus using such a content billing method.

2) Description of the Related Art

Corresponding to the development in the computer technology and the widely spreading use of communication networks such as the Internet in recent years, exchange of high quality digital data through Internet connection equipment including a personal computer without deterioration of the digital data has been becoming increasingly easy. Accordingly, the extent of distribution of digital content such as programs, music, images, moving images, games, and the like has been becoming greater.

However, one feature of digital content is that copying, editing, delivery, and the like are easy. That is, digital content is vulnerable to unauthorized use by unauthenticated users. In order to protect copyrights of digital content in the above situation, in a current system, digital content is managed by embedding identification information in digital data based on a digital watermarking technique.

In addition, in order to prevent copying by users without permission, Japanese Unexamined Patent Publication, No. 2000-298689 discloses a management method, a management system, a recording apparatus, and a reproduction apparatus for digital literary works, in which the digital literary works are managed by embedding a route of use in digital content based on a digital watermarking technique.

Further, Japanese Unexamined Patent Publication, No. 2000-330873 discloses a content distribution system and a content distribution method, in which identification information is embedded in digital content based on a digital watermarking technique. In this case, an unauthorized-outflow-monitoring center collects related data, and unauthenticated digital content is handled as unauthorizedly used digital content.

On the other hand, charges for use of digital content are usually made to only primary users since the aforementioned feature of the digital content makes post-purchase management difficult. Therefore, for example, contract terms are set so as to prohibit unauthorized conducts such as unauthorized editing or resale. In addition, digital content is encrypted, and copying and delivery of the encrypted digital content is permitted. In this case, a charge is made for an encryption key which is used for decoding the encrypted digital content when the digital content is used. Further, unauthorized use of digital content is monitored, and another charge is made for the unauthorized use. That is, various measures are taken so that a proper charge is paid.

However, in the conventional content billing systems which make a charge for use of digital content for protecting copyrights of the digital content, billing processing corresponding to various types of use of digital content is not performed.

According to the conventional techniques, it is difficult to keep track of various types of use of digital content after purchase, and charges are made to only primary users. In order to pay proper royalties to copyright owners, purchase prices are usually set on the higher side in consideration of various cases. For example, since it is impossible to recognize whether digital content is used permanently or temporarily, a higher purchase price is set on the assumption that the digital content is permanently used. In addition, in the case where a piece of digital content which has been purchased is required to be widely used in a company, it is necessary to perform a bothersome procedure, for example, for purchasing further copies of the digital content or changing a contract term so that copying is permitted.

Further, for the purpose of copyright protection or the like, an ID or password may be required to be input when a piece of digital content is used, where the ID or password is issued when the piece of digital content is purchased. However, in this case, the management of the ID or password is likely to become bothersome work, and use of service is limited. For example, only specific persons which are registered for the service can use the digital content.

As explained above, the conventional billing processing for digital content, which is performed in order to protect copyrights of the digital content, is fixed processing which is determined in consideration of various cases. That is, the conventional content billing processing is not flexible according to various types of use.

SUMMARY OF THE INVENTION

The present invention is made in view of the above problems, and the object of the present invention is to provide a content billing method, a content billing system and a content billing apparatus which perform billing processing corresponding to use of digital content and protecting copyrights of the digital content.

In order to accomplish the above object, a content billing method for performing billing processing for digital content in which identification information is embedded by using a digital watermarking technique on a computer is provided. The content billing method is characterized by comprising the steps of: (a) searching for a plurality of digital content items, and collecting information on whether or not the plurality of digital content items exist; (b) extracting identification information embedded in advance in the plurality of digital content items, and generating and recording use information on the plurality of digital content items based on the identification information; (c) recognizing a status of use in a predetermined period based on comparison of the newest use information and older use information which is recorded, and generating state-of-use information; and (d) calculating a use fee for digital content according to the state-of-use information.

In addition, in order to accomplish the above object, a content billing system for performing billing processing for digital content in which identification information is embedded by using a digital watermarking technique is provided. The content billing system is characterized by comprising a monitoring apparatus and a content billing apparatus being connected to the monitoring apparatus through the communication network. The monitoring apparatus includes: an automatic-search-and-collection means which searches for at least one predetermined digital content item existing in at least one computer connected to a predetermined communication network, and collects information on whether or not the at least one predetermined digital content item exists; a search management means which manages a predetermined search period which is preset, and activates the automatic-search-and-collection means when the predetermined search period expires; and an identification-information recognition means which extracts identification information embedded in advance in the at least one predetermined digital content item which is searched for by the automatic-search-and-collection means, and generates use information on the at least one predetermined digital content item based on the identification information. The content billing apparatus includes; a use-information management means which acquires the use information through the communication network, records the acquired use information in a predetermined storage device, and manages the stored use information; a use-information recognition means which recognizes a status of use in a predetermined period based on comparison of use information which is newly recorded and older use information which is recorded in the predetermined storage device for each predetermined section, and generates state-of-use information; and a use-fee calculation means which calculates a use fee for digital content according to the state-of-use information.

Further, in order to accomplish the above object, a content billing apparatus for performing billing processing for digital content in which identification information is embedded by using a digital watermarking technique is provided. The content billing apparatus is characterized by comprising: a use-information management means which acquires use information on at least one predetermined digital content item used in a predetermined communication network and detected based on identification information embedded in advance in the at least one predetermined digital content item, records the acquired use information in a predetermined storage device, and manages the stored use information; a use-information recognition means which recognizes a status of use in a predetermined period based on comparison of use information which is newly recorded and older use information which is recorded in the predetermined storage device for each predetermined section, and generates state-of-use information; and a use-fee calculation means which calculates a use fee for digital content according to the state-of-use information.

The above and other objects, features and advantages of the present invention will become apparent from the following description when taken in conjunction with the accompanying drawings which illustrate preferred embodiment of the present invention by way of example.

BRIEF DESCRIPTION OF THE DRAWINGS

In the drawings:

FIGS. 4(A), (B), and (C) are diagrams illustrating an example of a search-period file associated with the present invention;

FIG. 5 is a diagram illustrating an example of a search-destination file associated with the present invention;

FIG. 10 is a diagram illustrating an example of a use-information file associated with the present invention;

FIG. 11 is a diagram illustrating an example of a construction of a use-information database associated with the present invention;

FIG. 14 is a diagram illustrating an example of a status-of-use file generated by the differential-content extraction processing associated with the present invention;

FIG. 17 is a diagram illustrating an example of a state-of-use file generated by the continuing-content extraction processing associated with the present invention;

FIG. 18 is a diagram illustrating an example of a fee table associated with the present invention;

FIG. 24 is a diagram illustrating an example of a billing table associated with the present invention.

DESCRIPTION OF THE PREFERRED EMBODIMENTS

Embodiments of the present invention are explained below with reference to drawings.

Figure 1:
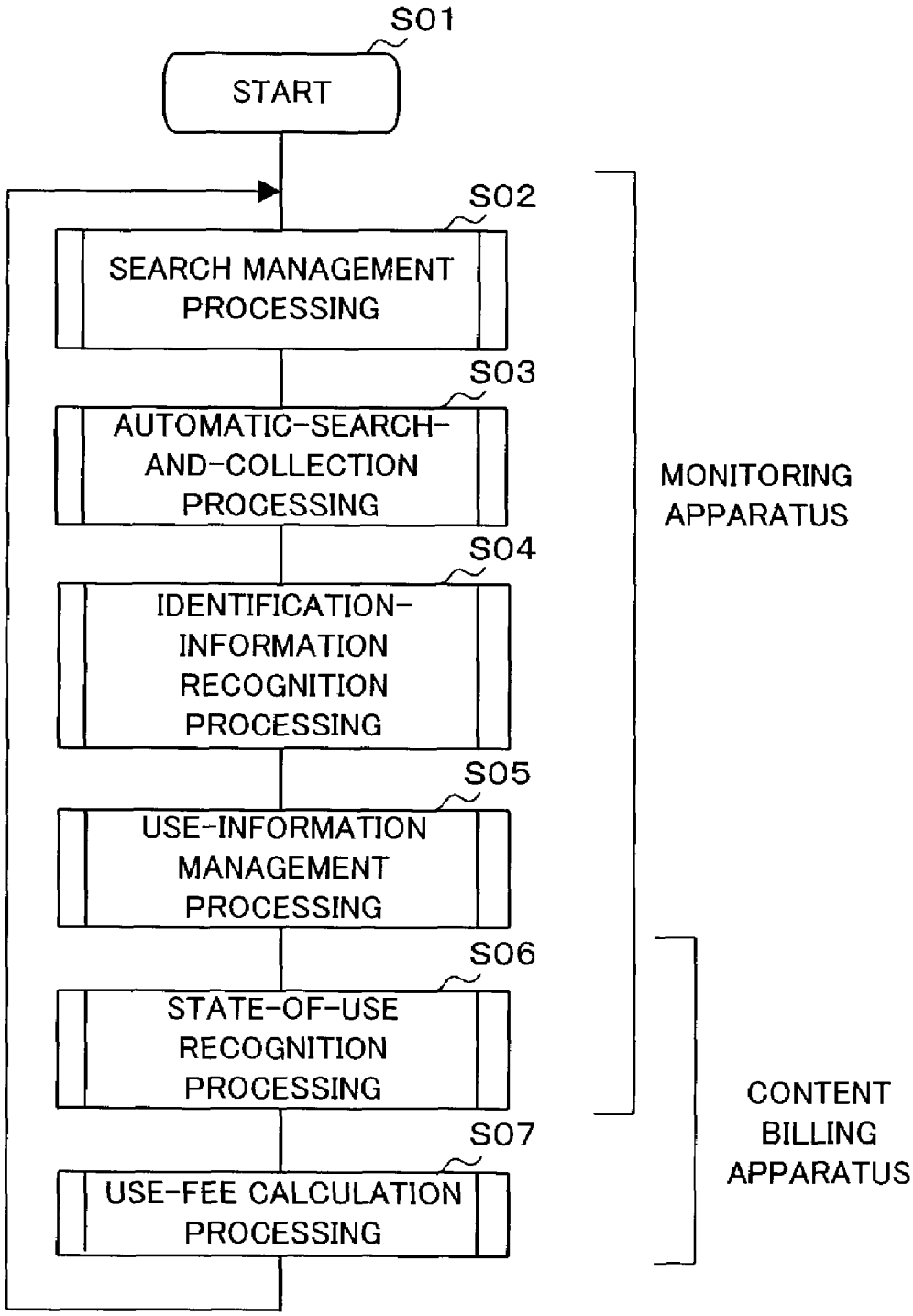
FIG. 1 is a flowchart of a content billing method as an embodiment of the present invention.

FIG. 1 is a flowchart of a content billing method as an embodiment of the present invention. Hereinafter, digital content is simply referred to as content.

A sequence of content billing processing in accordance with the content billing method according to the present invention is executed by a monitoring apparatus and a content billing apparatus. The monitoring apparatus monitors content existing in a computer which is connected to predetermined communication network, and detects a state of use of the content. The content billing apparatus performs billing processing in which a use fee corresponding to the state of use detected by the monitoring apparatus is calculated.

The sequence of the content billing processing according to the present invention is started by activating the monitoring apparatus (S01). In the search management processing (S02), the monitoring apparatus performs processing for management of a preset search period, and determines whether or not the search period expires. When the search period expires, the operation goes to automatic-search-and-collection processing (S03) When the search period does not expire, the monitoring apparatus waits for expiration of the search period.

When the search period expires, the automatic-search-and-collection processing (S03) is performed. In the automatic-search-and-collection processing (S03), predetermined content existing in a predetermined communication network to which the monitoring apparatus is connected is searched for, information on whether or not content exists is collected, and searched-file information on a location in which content exists (e.g., a path to a content file) is generated.

Subsequently, in identification-information recognition processing (S04), the monitoring apparatus extracts identification information embedded in the content which is searched for based on the searched-file information, and generates use information on the content based on the identification information.

Thereafter, processing is performed for recognizing a state of use of the content in a predetermined period based on the use information, and calculating a use fee corresponding to the state of use. The processing for recognizing the state of use of content may be performed by either the monitoring apparatus or the content billing apparatus.

In use-information management processing (S05), the use information generated in the identification-information recognition processing (S04) is stored in a use-information database for management of the use information.

In state-of-use recognition processing (S06), the newest use information and use information in the past which is stored in the use-information database are compared for each predetermined section which is preset, a state of use of content in the predetermined period is recognized, and state-of-use information is generated. The recognized state of use includes information on a duration in which content is used and information on a manner of use. For example, the information on the duration indicates whether use of content is newly started, continued, or completed, and the information on the manner of use indicates whether or not the content is copied.

When the state-of-use information is generated in the state-of-use recognition processing (S06), a fee for use of the content corresponding to the state-of-use information is calculated in use-fee calculation processing (S07). At this time, when necessary, discount information concerning discounts is referred to in order to determine whether or not a discount can be received, and the processing for calculation of the use fee includes applicable discount processing. The processing for calculation of the use fee is performed by the content billing apparatus.

As explained above, in the content billing method according to the present invention, predetermined content existing in a computer connected to a predetermined communication network is searched for, use information is generated based identification information embedded in the content, a status of use in a predetermined period is recognized based on the use information, and a use fee corresponding to the status of use is calculated. Therefore, it is possible to calculate an appropriate use fee based on an actual situation of content. In addition, the present invention can provide a flexible content billing method. For example, it is possible to apply various types of discounts according to the duration and amount of use.

Figure 2:
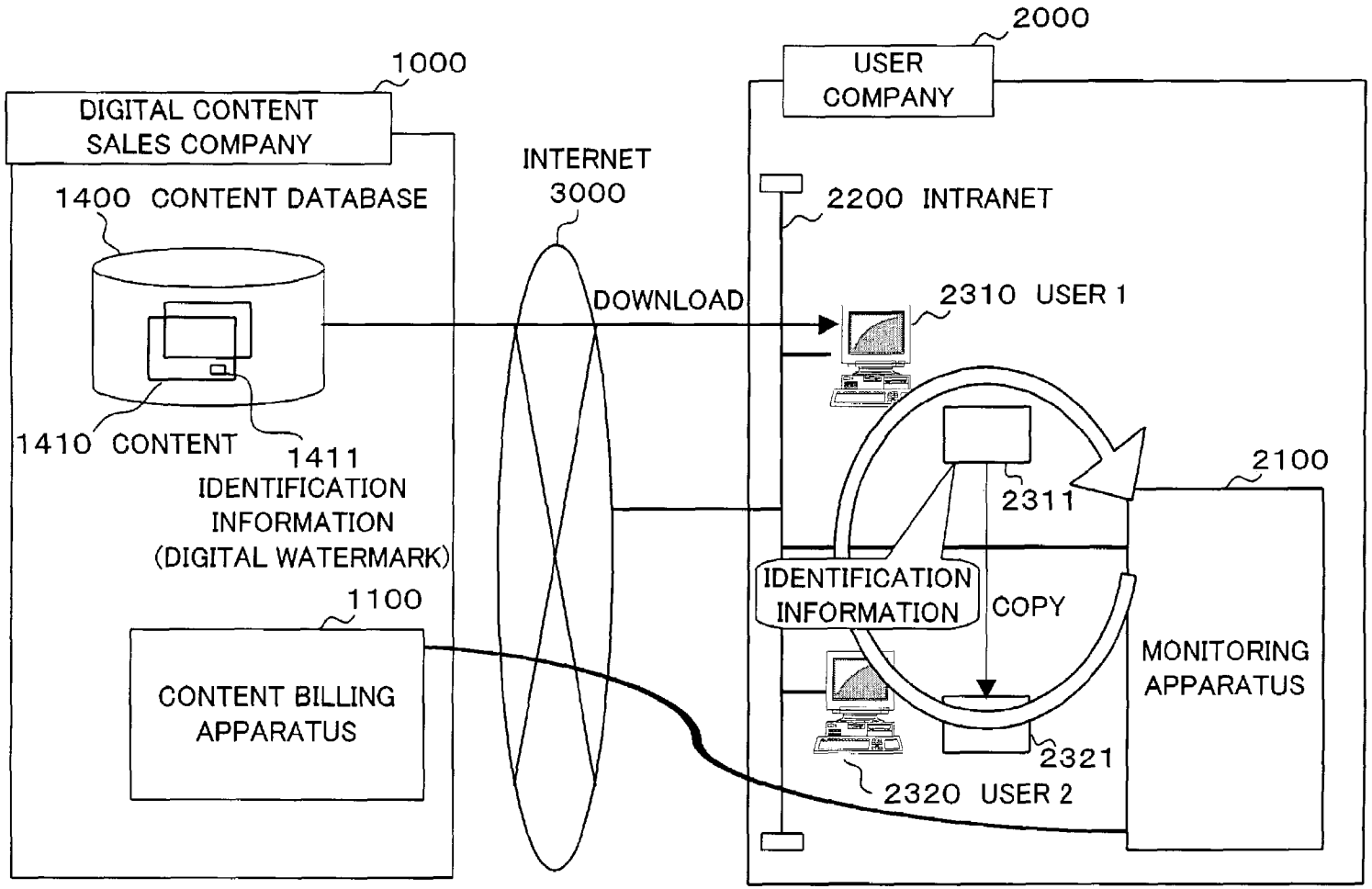
FIG. 2 is a diagram illustrating an outline of a construction of a content billing system for realizing the content billing method as the embodiment of the present invention.

Next, a content billing system in which the above content billing method is performed is explained below. FIG. 2 is a diagram illustrating an outline of a construction of a content billing system for realizing the content billing method as an embodiment of the present invention.

A digital content sales company 1000 which sells content and a user company 2000 which uses the content are connected through a communication network such as the Internet 3000.

The digital content sales company 1000 manages content 1410 for sale in a content database 1400, and allows a user to download the content 1410 through the Internet 3000 or a recording medium in response to a request from the user. Identification information 1411 for identifying the content 1410 is embedded in the content 1410 by using a digital watermarking technique. At the time of the download, customer information concerning a customer as the destination of the download is obtained and transferred to a content billing apparatus 1100. The content billing apparatus 1100 obtains use information on content from a monitoring apparatus 2100 through the Internet 3000, where the monitoring apparatus 2100 is arranged in the user company 2000.

In the user company 2000, a plurality of user computers such as the user 1 (2310) and the user 2 (2320) are connected through an intranet (intra-company network) 2200. Content can be used in various manners. For example, downloaded content 2311 may be used by only the user 1 (2310), or may further be copied and used by the user 2 (2320) as content 2321. The monitoring apparatus 2100 is connected to the intranet 2200, searches for content existing in the computers connected to the intranet 2200 such as the user 1 (2310) and the user 2 (2320), generates use information on the content, and passes the use information to the content billing apparatus 1100.

Figure 3:
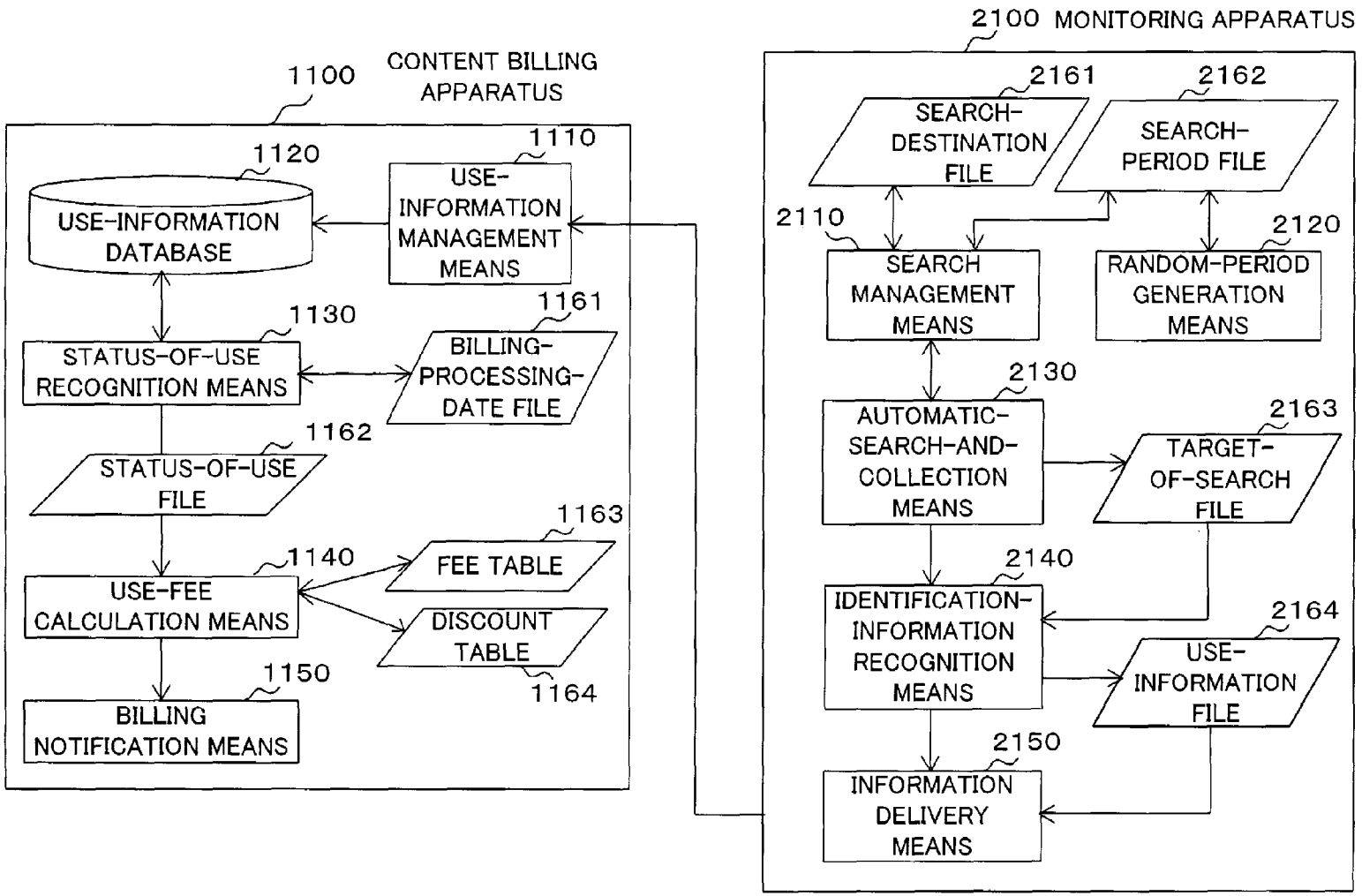
FIG. 3 is a diagram illustrating a construction of a content billing system as an embodiment of the present invention.

The constructions of the monitoring apparatus 2100 and the content billing apparatus 1100 are explained below. The monitoring apparatus 2100 monitors the content in the intranet 2200, and the content billing apparatus 1100 performs billing processing for the content. FIG. 3 is a diagram illustrating a construction of a content billing system as an embodiment of the present invention. In FIG. 3, the same elements as FIG. 2 respectively bear the same reference numerals as FIG. 2, and the same explanations are not repeated.

The monitoring apparatus 2100 comprises a search management means 2110, a random-period generation means 2120, an automatic-search-and-collection means 2130, an identification-information recognition means 2140, and an information delivery means 2150. The search management means 2110 manages a search period in which the content in the computers connected to the intranet 2200 is searched for. The random-period generation means 2120 generates a random period as the search period. The automatic-search-and-collection means 2130 searches for the content. The identification-information recognition means 2140 generates use information based on identification information in the content which is searched for. The information delivery means 2150 transmits the use information to the content billing apparatus 1100.

The search management means 2110 refers to a search-destination file 2161 and a search-period file 2162, determines, based on the search-period file 2162, whether or not the search period expires, and activates the automatic-search-and-collection means 2130 when the search period expires. It is possible to select a fixed or random period as the search period in the search-period file 2162. The fixed search period is set based on a time, a day of the week, a date geared to the calendar, or the like. On the other hand, in the case of the random search period, a time, a day of the week, and a date are randomly set by the random-period generation means 2120. The purpose of the setting of the random search period is to prevent unfair conduct such as billing evasion by deletion of a file or movement of content to an external hard disk drive at the time of the search in the user company.

The random-period generation means 2120 generates a random number for setting the random search period.

The automatic-search-and-collection means 2130 searches for content in the intranet based on the search-destination file 2161 which designates network addresses and host addresses of targets of the search, and produces as a result of the search a target-of-search file 2163 including information on content as the targets of the search.

The identification-information recognition means 2140 extracts identification information embedded in the content as the targets of the search based on the target-of-search file 2163. When the extracted identification information is identification information embedded by the digital content sales company 1000, the identification-information recognition means 2140 generates use information based on the identification information, and updates a use-information file 2164 with the use information.

The information delivery means 2150 transmits the updated use-information file 2164 to the content billing apparatus 1100.

The content billing apparatus 1100 comprises a use-information management means 1110, a use-information database 1120, a status-of-use recognition means 1130, a use-fee calculation means 1140, and a billing notification means 1150. The use-information management means 1110 acquires the use information, and records the use information in the use-information database 1120 for management of the use information. The use-information database 1120 stores the use information. The status-of-use recognition means 1130 recognizes a state of use based on the use information. The use-fee calculation means 1140 calculates a use fee corresponding to the status of use. The billing notification means 1150 makes notification of the calculated use fee.

Specifically, the use-information management means 1110 acquires the use-information file 2164 from the monitoring apparatus 2100, and stores the use-information file 2164 in the use-information database 1120 for management of the use information.

The status-of-use recognition means 1130 is activated on a billing processing date which is registered in a billing-processing-date file 1161, where the billing processing date is set in advance for charging the use fee. The status-of-use recognition means 1130 compares the newest use information with use information in the past which is recorded in the use-information database 1120, and recognizes, based on a difference in the number of uses or the like, a first aspect of the state of use concerning a period of use (e.g., a start, an end, and a continuation of use) and a second aspect of the state of use concerning a manner of use (e.g., whether or not content is copied). Then, the status-of-use recognition means 1130 produces a status-of-use file 1162.

The use-fee calculation means 1140 refers to a fee table 1163 based on the information in the status-of-use file 1162, and calculates prices for content, where a fee for each content item is set in the fee table 1163. Subsequently, the use-fee calculation means 1140 refers to a discount table 1164, performs applicable discount processing, and calculates a final use fee, where conditions for and discount rates in various types of discounts are set in the discount table 1164.

The billing notification means 1150 makes notification of the calculated final fee (e.g., a billing log) for use of digital content to a person in charge of billing processing or the like in the digital content sales company 1000.

Next, operations of the content billing system having the above construction are explained below.

The digital content sales company 1000 sells content in response to a request from the user company 2000. The content 1410 stored in the content database 1400 is downloaded through the Internet 3000 to a user, e.g., the user 1 (2310) in the user company 2000.

When the search period expires, the search management means 2110 in the monitoring apparatus 2100 in the user company 2000 activates the automatic-search-and-collection means 2130. The automatic-search-and-collection means 2130 searches for content in the user computers connected to the intranet 2200, and produces the target-of-search file 2163 concerning target content in the search. The identification-information recognition means 2140 extracts identification information in the target content based on the target-of-search file 2163. When the target content is recognized to belong to the digital content sales company 1000 based on the identification information, the identification-information recognition means 2140 generates use information, and registers the use information in the use-information file 2164. The produced use-information file 2164 is transmitted by the information delivery means 2150 to the content billing apparatus 1100 in the digital content sales company 1000.

The use-information management means 1110 in the content billing apparatus 1100 acquires the use information from the monitoring apparatus 2100, and records the use information in the use-information database 1120. The status-of-use recognition means 1130 retrieves the newest use information and use information in the past which is recorded in the use-information database 1120 for each predetermined section (e.g., each billing processing date), recognizes a status of use by comparing the newest use information and use information in the past, and produces the status-of-use file 1162. The use-fee calculation means 1140 searches the fee table 1163 and the discount table 1164 based on the state of use registered in the status-of-use file 1162, and calculates a fee corresponding to the state of use of the content. The billing notification means 1150 makes notification of the calculated use fee to the person in charge.

According to the above content billing system, the digital content sales company 1000 can collect an appropriate use fee based on the actual situation of content used in the intranet 2200 of the content user company 2000. In addition, since unauthorized use of content can be monitored for by search for the content, it is possible to protect copyrights of content. Further, it is possible to automatize the operations for flexible billing corresponding to the actual situation of use (e.g., the duration and amount of use) and various types of discounts. Furthermore, since the actual situation of use of content can be recognized, it is possible to revise and lower a unit price of the content. On the other hand, users are required to pay a fee corresponding to only actual use of content, and can benefit from a price drop which may be realized by revision of a unit price of content. In addition, it is possible to reduce the operations for obtaining various types of permission which are required at the time of copying or purchase of a new copy.

Details of the sequence of each processing are explained below.

In the following explanations, it is assumed that the monitoring apparatus 2100 performs the search management processing (S02), the automatic-search-and-collection processing (S03), and the identification-information recognition processing (S04).

First, explanations of the search management processing (S02) are provided below. The search management processing (S02) is performed by the search management means 2110 and the random-period generation means 2120 referring to the search-destination file 2161 and the search-period file 2162.

The explanations are started from the search-destination file 2161 and the search-period file 2162. FIGS. 4(A) to (C) show an example of the search-period file associated with the present invention. In the search-period file 2162, it is possible to choose one of fixed and random search modes, and set the search period in minutes, hours, days, months, and days of the week. In the example 1, a fixed search period is registered by the date and time of the search, the 31th day of every month and 16 o'clock. That is, the search mode is set to "fixed," and the search period is set by the minute "0," the hour "16," and the day "31." Similarly, in the example 2, a fixed search period is registered by the date and time of the search, every Friday and 0:30.

FIG. 5 shows an example of the search-destination file associated with the present invention. In the search-destination file 2161, network addresses (e.g., network address 1, . . . network address 3, . . . ) in the network to be searched and host addresses (e.g., host address 1, . . . host address 3, . . . ) are registered. When the entire network is searched, for example, "*" is registered. The search-destination file 2161 is set for preventing unnecessary searches.

Figure 6:
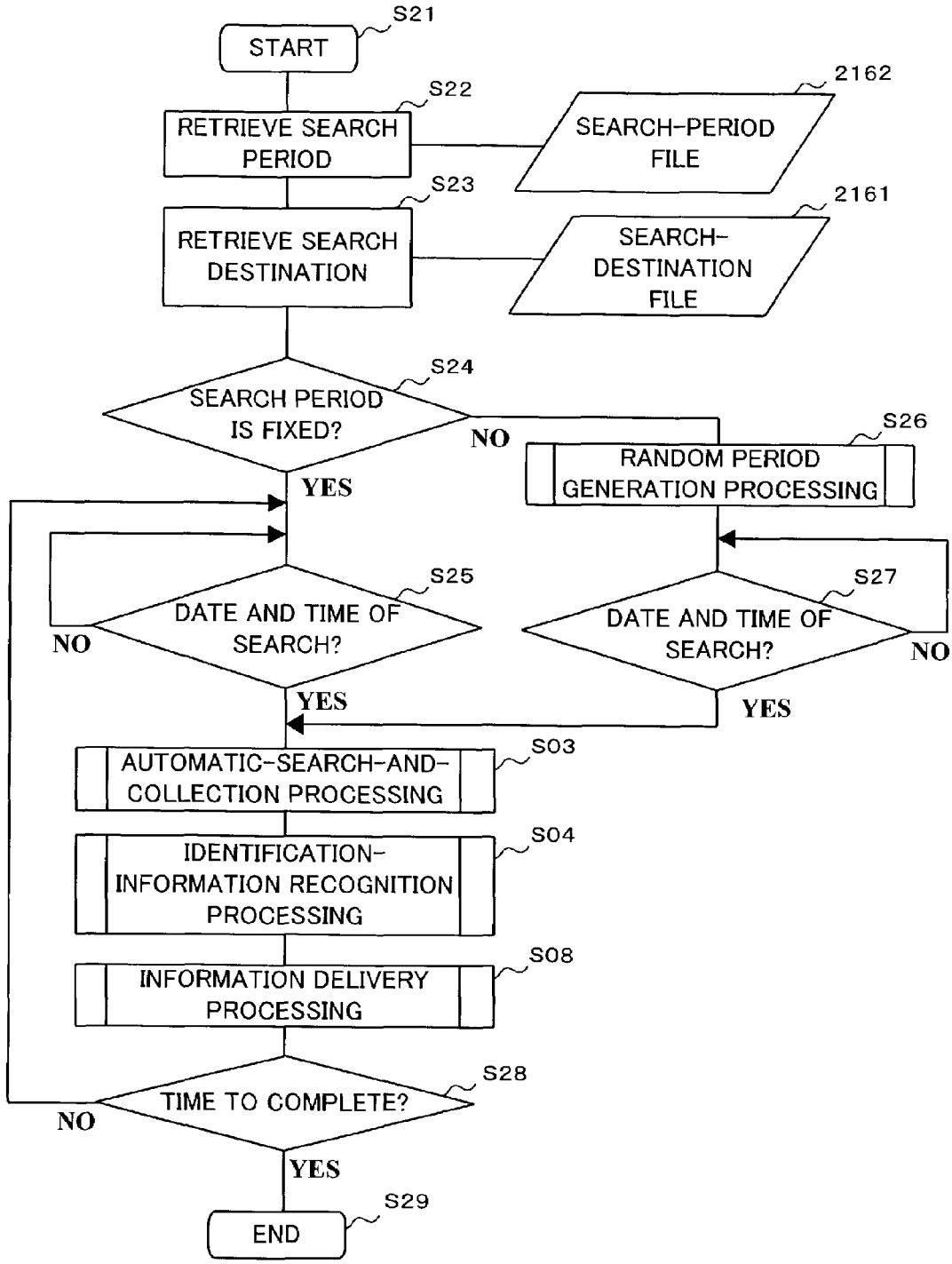
FIG. 6 is a flowchart of a sequence of search management processing in an embodiment of the present invention.

Next, the search management processing is explained. FIG. 6 is a flowchart of a sequence of the search management processing in an embodiment of the present invention. In FIG. 6, the same elements as FIGS. 1 and 3 respectively bear the same reference numerals as FIGS. 1 and 3, and the same explanations are not repeated. The processing is started when the monitoring apparatus 2100 is activated (S21). First, the search-period file 2162 concerning the search period is retrieved (S22), and then the search-destination file 2161 is retrieved (S23). At this time, it is determined whether or not the search period is fixed, based on the setting in the search-period file 2162 (S24). When the search period is fixed, it is determined whether or not the preset date and time of the search is reached (S25). When the preset date and time of the search is not reached, the operation waits for the preset date and time of the search. When the preset date and time of the search is reached, the automatic-search-and-collection processing (S03), the identification-information recognition processing (S04), and the information delivery processing (S08) are performed, and it is determined whether or not a time to complete is reached (S28). When the time to complete is reached, the sequence of FIG. 6 is completed (S29). When the time to complete is not reached, the operations beginning from step S25 are repeated. In the case where the search period is random, random-period generation processing (S26) is performed, and a date and time of only one search is set based on a random number. Subsequently, it is determined whether or not the preset date and time of the search is reached (S27). When the preset date and time of the search is not reached, the operation waits for the preset date and time of the search. When the preset date and time of the search is reached, the operation goes back to step S03.

Figure 7:
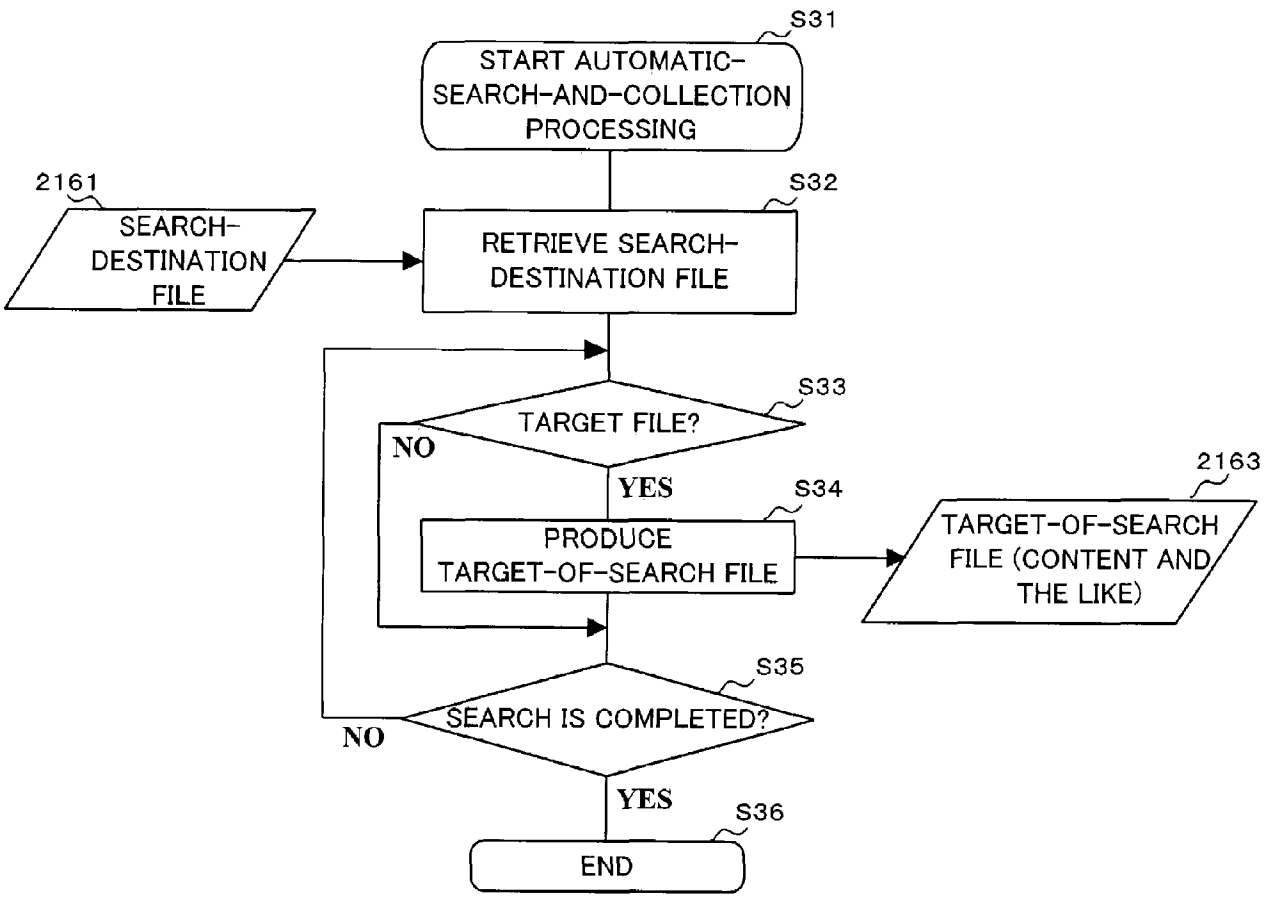
FIG. 7 is a flowchart of a sequence of automatic-search-and-collection processing in an embodiment of the present invention.

The automatic-search-and-collection processing (S03) is explained below. The automatic-search-and-collection processing is performed by the automatic-search-and-collection means 2130 which is activated by the search management means 2110. FIG. 7 is a flowchart of a sequence of the automatic-search-and-collection processing in an embodiment of the present invention. In FIG. 7, the same elements as FIGS. 1 and 3 respectively bear the same reference numerals as FIGS. 1 and 3, and the same explanations are not repeated. At the preset date and time of the search, the automatic-search-and-collection processing is started (S31), and the search-destination file 2161 is retrieved (S32). When the search-destination file 2161 is passed from the search management processing, the operation in step S32 is dispensed with. Subsequently, computers at the network addresses or the host addresses set in the search-destination file 2161 are searched for, and it is determined whether or not a file of content as a target of the search exists (S33). When the file of content as the target of the search exists, information necessary for the identification-information recognition processing (S04) (which follows the automatic-search-and-collection processing (S03)) is registered in the target-of-search file 2163, and the target-of-search file is produced (S34), where the information necessary for the identification-information recognition processing (S04) includes, for example, a path to the file. When no file of content as a target of the search exists, it is determined whether or not the search is completed (S35) after the registration in step S34. When the search is not completed, the operations beginning from step S33 are repeated, and a target of the search is registered in the target-of-search file 2163. When the search is completed, the automatic-search-and-collection processing is completed (S36).

Explanations of the identification-information recognition processing (S04) are provided below. The identification-information recognition processing is performed by the identification-information recognition means 2140.

Figure 8:
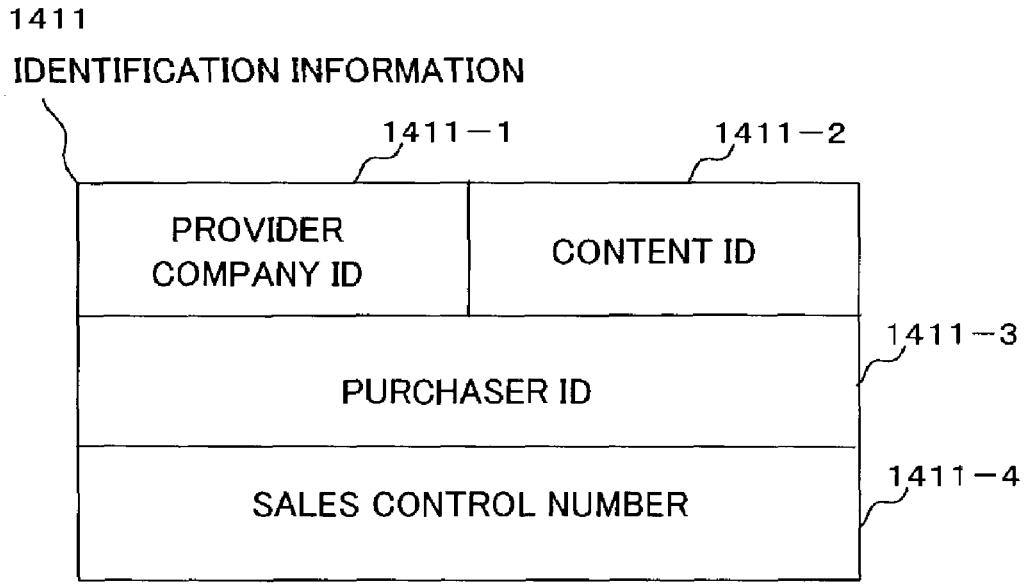
FIG. 8 is a diagram illustrating an example of identification information embedded in a piece of content associated with the present invention.

Before the explanations of the identification-information recognition processing (S04) per se, the identification information is explained. FIG. 8 shows an example of the identification information embedded in a piece of content associated with the present invention. The identification information is embedded in content by using a digital watermarking technique, and cannot be falsified by users. The identification information is constituted by a provider company ID (1411-1), a content ID (1411-2), a purchaser ID (1411-3), and a sales control number (1411-4). The provider company ID (1411-1) identifies a company which provides the content, the content ID (1411-2) identifies the content, and the purchaser ID (1411-3) identifies a customer who purchases the content. Based on the provider company ID (1411-1) and the content ID (1411-2), it is possible to confirm that the content belongs to the digital content sales company. Based on the purchaser ID (1411-3), it is possible to confirm that the content has been purchased by the user company. The sales control number (1411-4) is information for uniquely determining the content, and constituted by, for example, a combination of a date and time of sale and a unique number. Thus, it is possible to recognize whether the content is newly purchased or copied.

Figure 9:
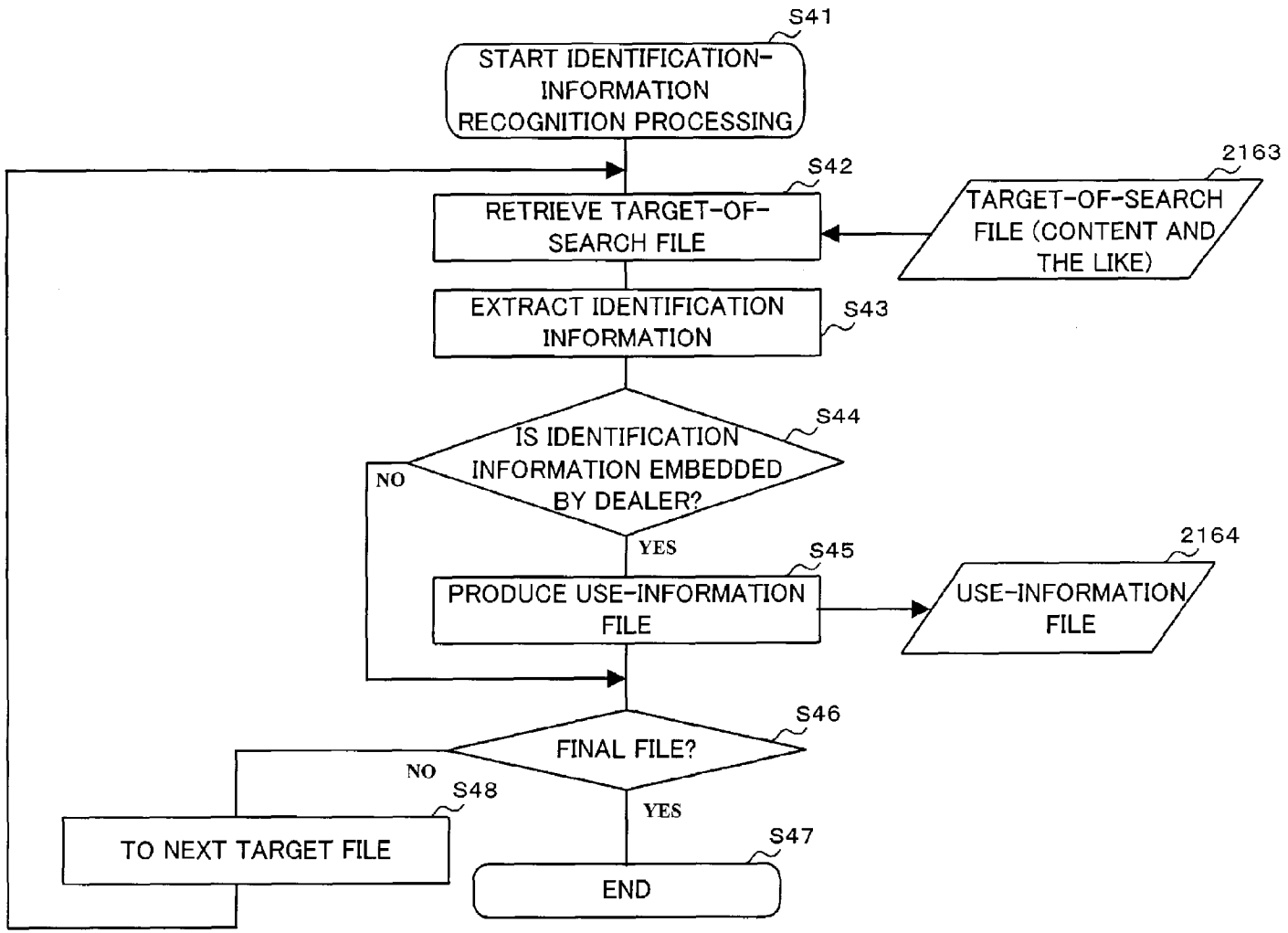
FIG. 9 is a flowchart of a sequence of identification-information recognition processing in an embodiment of the present invention.

The identification-information recognition processing (S04) is explained. FIG. 9 is a flowchart of a sequence of the identification-information recognition processing in an embodiment of the present invention. In FIG. 9, the same elements as FIGS. 1 and 3 respectively bear the same reference numerals as FIGS. 1 and 3, and the same explanations are not repeated.

By the processing performed before the identification-information recognition processing, the location in which target content exists has been searched for, and registered in the target-of-search file 2163. When the identification-information recognition processing is started (S41), the target-of-search file 2163 is retrieved, and the location of a target file in which the content is stored is retrieved (S42). Subsequently, identification information embedded in the target file is extracted (S43), and it is determined whether or not the provider company ID (1411-1) indicates that the identification information is embedded by a predetermined dealer, i.e., whether or not the status of use of the content is required to be recognized (S44). When the provider company ID (1411-1) indicates that the identification information is embedded by the predetermined dealer, the extracted identification information is registered in the use-information file 2164 (S45). When the provider company ID (1411-1) indicates that the identification information is not embedded by the predetermined dealer, the extracted identification information is not registered in the use-information file. Then, it is determined whether or not the current target file is the final target file (S46). When the current target file is not the final target file, the operation goes to the next target file (S48), and the processing beginning from step S42 is performed. When the current target file is the final target file, the sequence of FIG. 9 is completed (S47).

The use-information file generated by the above sequence is explained. FIG. 10 shows an example of the use-information file associated with the present invention. A path name 2164-1 and a file name 2164-2 of the content obtained by the automatic-search-and-collection processing (S03) and a content ID 2164-3 and a sales control number 2164-4 in the identification information obtained by the identification-information recognition means are registered in the illustrated example 2164*a* of the use-information file.

The use-information file 2164 generated by the sequence explained above is transmitted by the information delivery means 2150 to the content billing apparatus 1100.

In this example, it is assumed that the use-information management processing (S05), the state-of-use recognition processing (S06), and the use-fee calculation processing (S07), which follow the processing explained before, are performed by the content billing apparatus 1100.

First, the use-information management processing (S05) is explained. The use-information management processing (S05) is performed by the content billing apparatus 1100. In the sequence of the use-information management processing, the use-information file 2164 acquired from the monitoring apparatus 2100 is recorded in the use-information database 1120 for management. FIG. 11 shows an example of a construction of the use-information database associated with the present invention. In this example, use information on the user corresponding to the customer code A123, which is classified according to the content IDs (P00001, P00002), is recorded in the order of the dates and times of the searches at which the use information is generated.

Next, explanations of the state-of-use recognition processing (S06) are provided below. The state-of-use recognition processing (S06) is performed by the status-of-use recognition means 1130. In the state-of-use recognition processing, the newest data and the past data stored in the use-information database 1120 are compared for each customer and each preset billing processing date, and appropriate state-of-use information is generated according to an object for which a use fee is charged. First to third examples of the state-of-use recognition processing are explained below. In the first example, differential-content processing is performed in the case where use of content newly starts and ends, and a difference occurs in the number of uses of content. In the second example, continuing-content processing is performed in the case where content is continuously used. In the third example, copied-content processing is performed in the case where content is copied.

Figure 12:
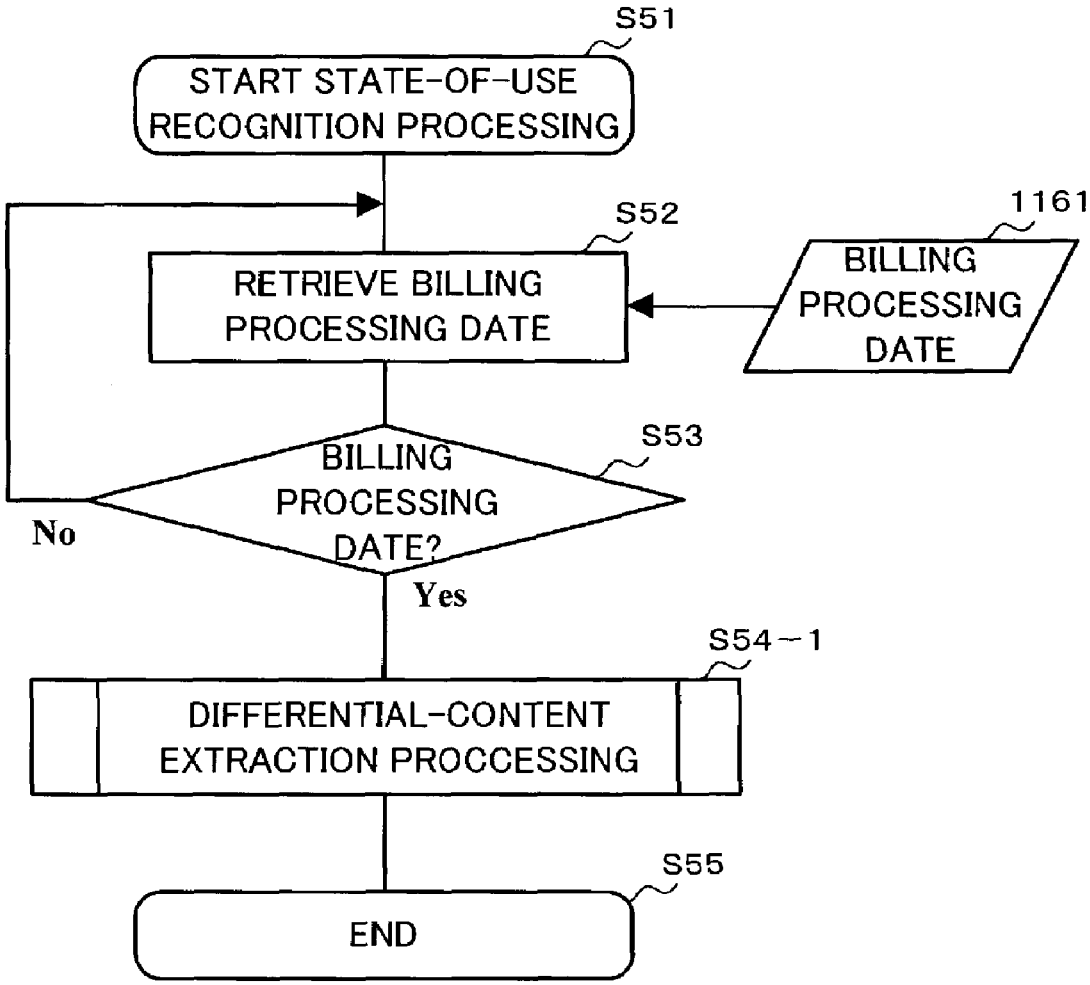
FIG. 12 is a flowchart of a first sequence of state-of-use recognition processing in an embodiment of the present invention.

The first example of the state-of-use recognition processing including the differential-content processing is explained. FIG. 12 is a flowchart of a first sequence of the state-of-use recognition processing in an embodiment of the present invention.

When the state-of-use recognition processing is started (S51), the billing-processing-date file 1161, in which a billing processing date is registered, is retrieved (S52), where processing concerning billing of a use fee, which is preset for each customer, is performed on the billing processing date. Then, it is determined whether or not the billing processing date is reached (S53). When the billing processing date is not reached, the operation goes back to step S52, and the processing beginning from the retrieving of the billing processing date is performed. When the billing processing date is reached, differential-content extraction processing (S54-1) is performed, and the sequence of FIG. 12 is completed (S55).

Figure 13:
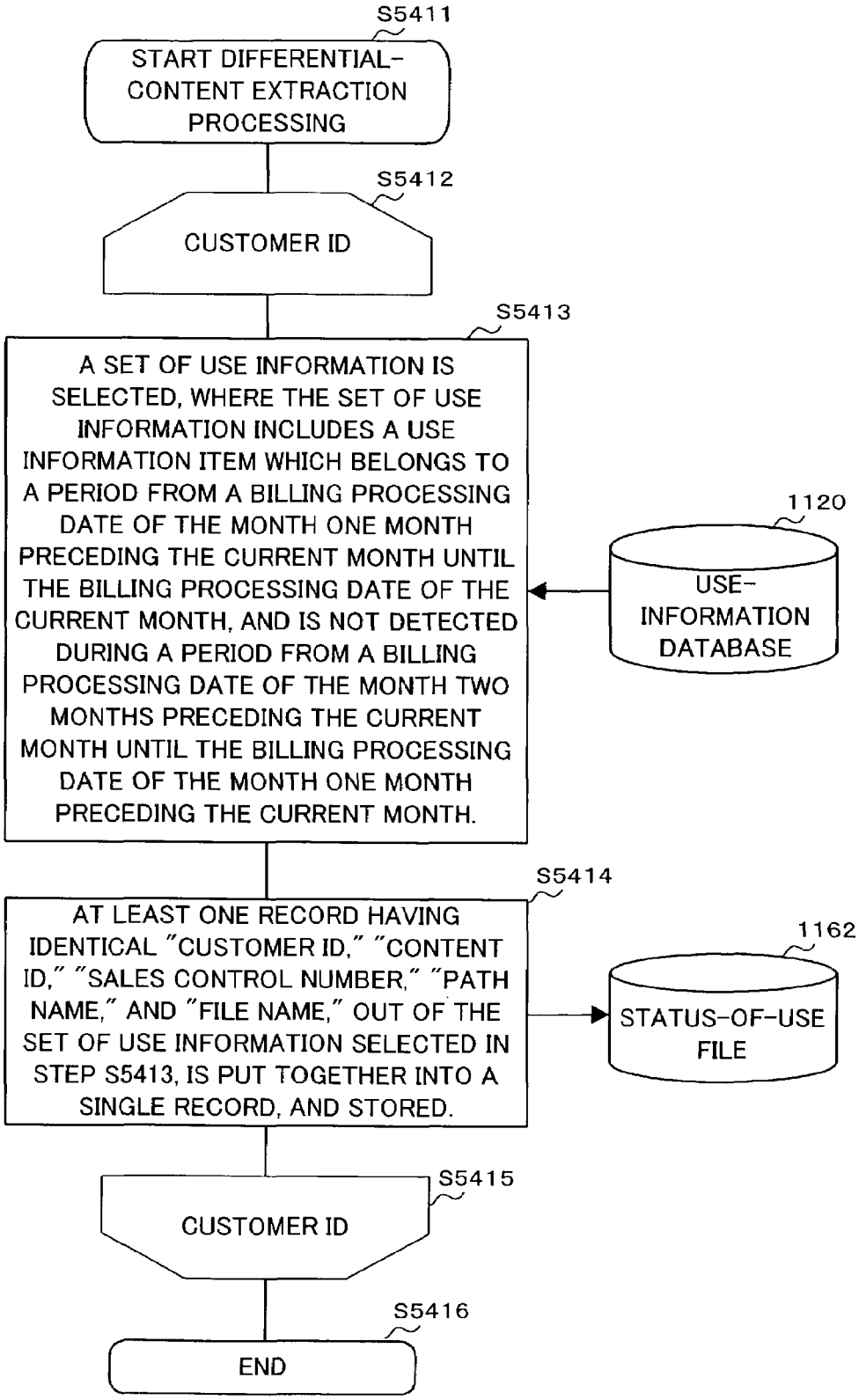
FIG. 13 is a flowchart of a sequence of differential-content extraction processing in the state-of-use recognition processing associated with the present invention.

Details of the differential-content extraction processing (S54-1) are explained. FIG. 13 is a flowchart of a sequence of the differential-content extraction processing in the state-of-use recognition processing associated with the present invention.

When the differential-content extraction processing is started (S5411), loop processing in steps S5412 to S5415 is repeated for the first to nth customers in turn by using the customer ID of each customer as a key. When the processing for the nth customer is completed, the sequence of FIG. 13 is completed (S5416). First, data stored in the use-information database 1120 is searched. At this time, a set of use information is selected (S5413), where the set of use information includes a difference of the use information at the current billing processing date from the use information at the preceding current billing processing date, i.e., the set of use information includes a use information item which belongs to a period from a billing processing date of the month one month preceding the current month until the billing processing date of the current month, and is not detected during a period from a billing processing date of the month two months preceding the current month until the billing processing date of the month one month preceding the current month. Subsequently, at least one record having identical "customer ID," "content ID," "sales control number," "path name," and "file name," out of the set of use information selected in step S5413, is put together into a single record, and stored in the status-of-use file 1162 (S5414).

According to the above processing, it is possible to recognize a status of use of content which is added during the period from the billing processing date of the month one month preceding the current month until the billing processing date of the current month. In addition, according to similar processing, it is possible to detect a use information item which exists at the billing processing date of the preceding month, and has become undetectable during the period from the billing processing date of the month one month preceding the current month until the billing processing date of the current month. That is, deletion of a use information item corresponding to completion of use can be detected.

FIG. 14 is a diagram illustrating an example of a status-of-use file 1162-1 generated by the differential-content extraction processing associated with the present invention. In the example of FIG. 14, in case of the status-of-use file 1162-1, at the billing processing date of November, new content items (corresponding to content IDs "P00001" and "P00002") for the customer A123 are detected, and are thereafter processed as items billed in November. At this time, the processing status becomes "completed." Similarly, a new content item (corresponding to a content ID "P00003") is detected at the billing processing date in December.

Figure 15:
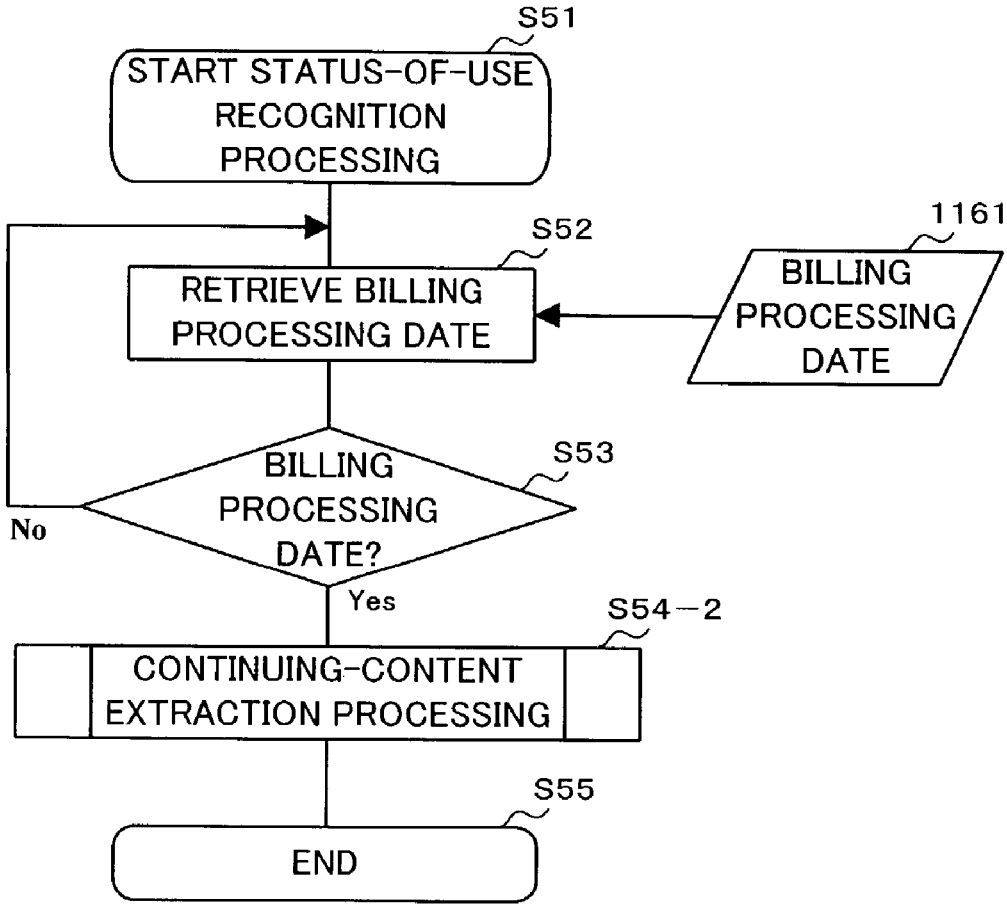
FIG. 15 is a flowchart of a second sequence of state-of-use recognition processing in an embodiment of the present invention.

The second example of the state-of-use recognition processing including the continuing-content processing is explained. FIG. 15 is a flowchart of a second sequence of the state-of-use recognition processing in an embodiment of the present invention. In FIG. 15, the same elements as FIG. 12 respectively bear the same reference numerals as FIG. 12, and the same explanations are not repeated.

The sequence of FIG. 15 is similar to the sequence of FIG. 12 except that continuing-content extraction processing (S54-2) is performed when the billing processing date is reached.

Figure 16:
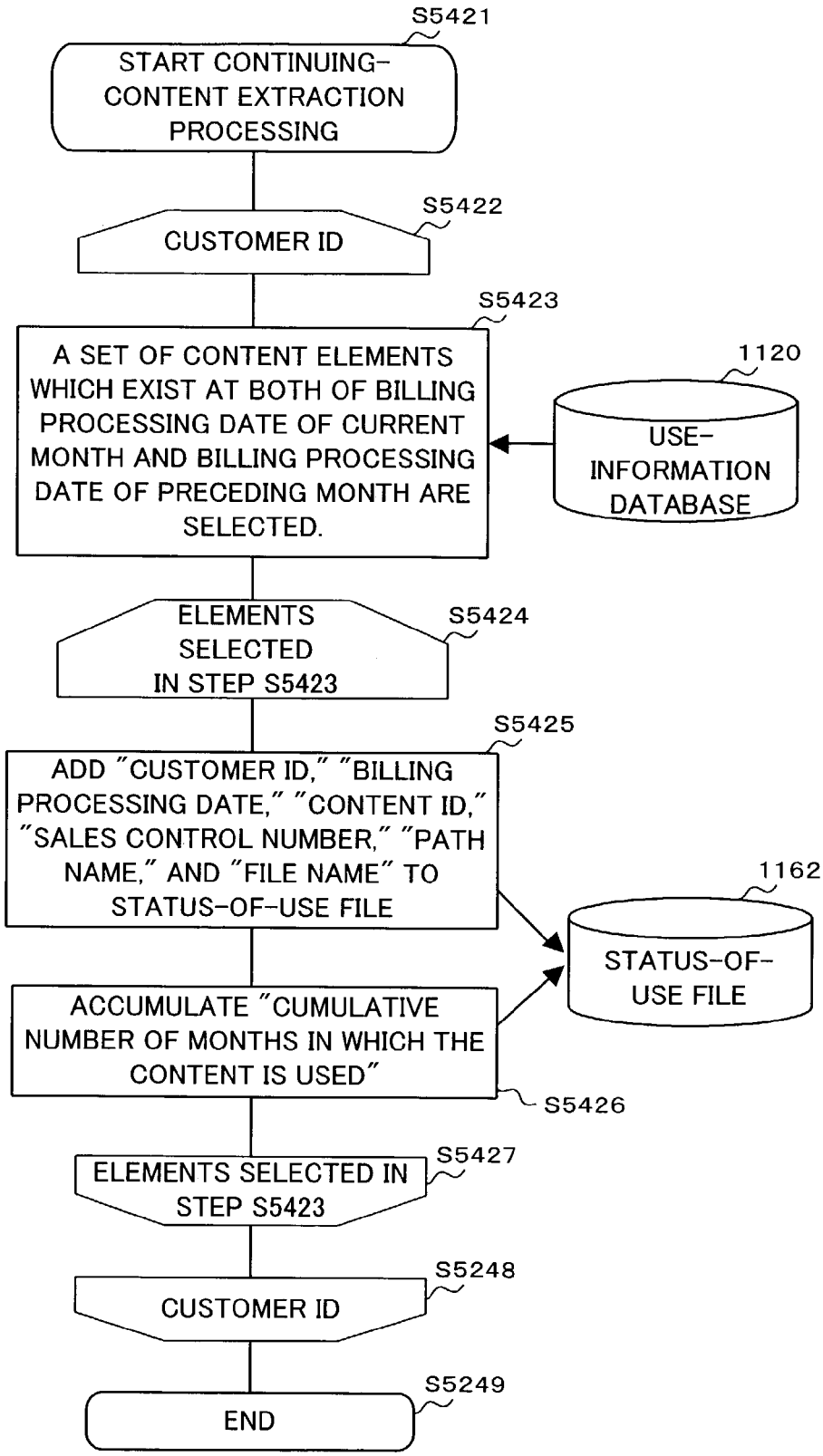
FIG. 16 is a flowchart of a sequence of continuing-content extraction processing in the state-of-use recognition processing associated with the present invention.

Details of the continuing-content extraction processing (S54-2) are explained. FIG. 16 is a flowchart of a sequence of the continuing-content extraction processing in the state-of-use recognition processing associated with the present invention.

When the continuing-content extraction processing is started (S5421), loop processing in steps S5422 to S5428 is repeated for the first to nth customers in turn by using the customer ID of each customer as a key. When the processing for the nth customer is completed, the sequence of FIG. 16 is completed (S5429). First, data stored in the use-information database 1120 is searched. At this time, a set of first to mth content which exist at both of the billing processing date of the current month and the billing processing date of the preceding month are selected (S5423). Then, the first to mth content, in turn, undergo the processing in steps S5425 to S5427. Subsequently, the "customer ID," "billing processing date," "content ID," "sales control number," "path name," and "file name" for the selected content are added to the status-of-use file 1162 (S5425), and an "cumulative number of months in which the content is used" is accumulated (S5426).

According to the above processing, it is possible to recognize a status of use of content which is continuously used.

FIG. 17 shows an example of a status-of-use file 1162-2 generated by the continuing-content extraction processing associated with the present invention. In the example of FIG. 17, in case of the status-of-use file 1622-2, at the billing processing date in November, the cumulative number of months in which the content having the content ID "P00001" is used is five. Thereafter, this information is processed as an item billed in November. At this time, the processing status becomes "completed." Since this content is further continuously used in December, and the cumulative number of months in which the content is used becomes six in December.

The third example of the state-of-use recognition processing including the copied-content processing is explained. When data in the use-information database 1120 is searched, and content items detected for different customer IDs have an identical content ID and sales control number, it is possible to determine that one of the content items is a copy. Alternatively, it is possible to check whether or not a newly detected content item is a copy by combination with the differential-content extraction processing explained before. According to the above processing, it is possible to recognize a status of use of content which is copied for use.

Explanations of the use-fee calculation processing (S07) are provided below. The use-fee calculation processing (S07) is performed by the use-fee calculation means 1140. In the use-fee calculation processing, a use fee is calculated by referring to the fee table 1163, in which a unit price is set for each content item.

The fee table is explained below. FIG. 18 shows an example of the fee table associated with the present invention. In the fee table 1163, a unit price of each content item is registered associated with a content ID.

Figure 19:
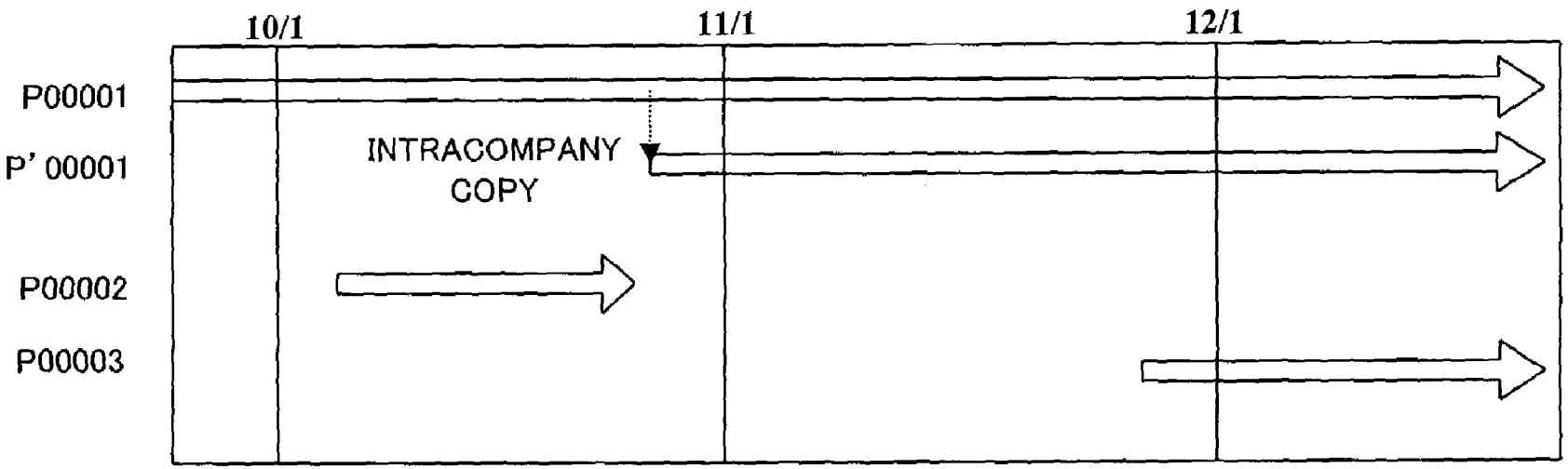
FIG. 19 is a diagram illustrating an example of use of content.

The following explanations are provided for the case where a use fee is calculated based on status-of-use information on the different content, the continuingly used content, and the copied content, and the status-of-use information is generated by the state-of-use recognition processing (S06) as explained before. FIG. 19 shows an example of use of content. In FIG. 19, "10/1," "11/1," and "12/1" indicate billing processing dates, "P00001" denotes a content item which is continuously used, "P'00001" denotes a content item which is copied in the company from the content item "P00001," "P00002" denotes a content item which is used for a duration shorter than one month, and "P00003" denotes a content item the use of which is started from halfway.

When an increased content item is detected in the differential-content extraction processing in the first example, a charge is made for the detected content item. In the case where a charge of one hundred yen is made for each item, the content item "P'00001" as the copy in the company and the newly purchased content item "P00002" are detected at the billing processing date "11/1," and one hundred yen is charged for each of the content items "P'00001" and "P00002." In addition, the newly purchased content item "P00003" is detected at the billing processing date "12/1," and one hundred yen is charged for the content item "P00003."

When a continuingly used content item is detected in the continuing-content extraction processing in the second example, e.g., when use of a content item continues for one month, a charge is made for the content item. In the case where a unit price is one hundred yen per month for each item, continuation of the content item "P00001" is detected at the billing processing date "11/1," and one hundred yen is charged for use of the content item "P00001" as a billed amount in October. In addition, the content item "P00001" and the content item "P'00001" as the copy in the company are detected at the billing processing date "12/1," and two hundred yen is charged for use of these content items as a billed amount in November.

When the content item "P'00001" is determined to be a copy in the copied-content processing in the third example, for example, it is possible to perform processing so that a unit price for the copy is identical to the use fee.

Figure 20:
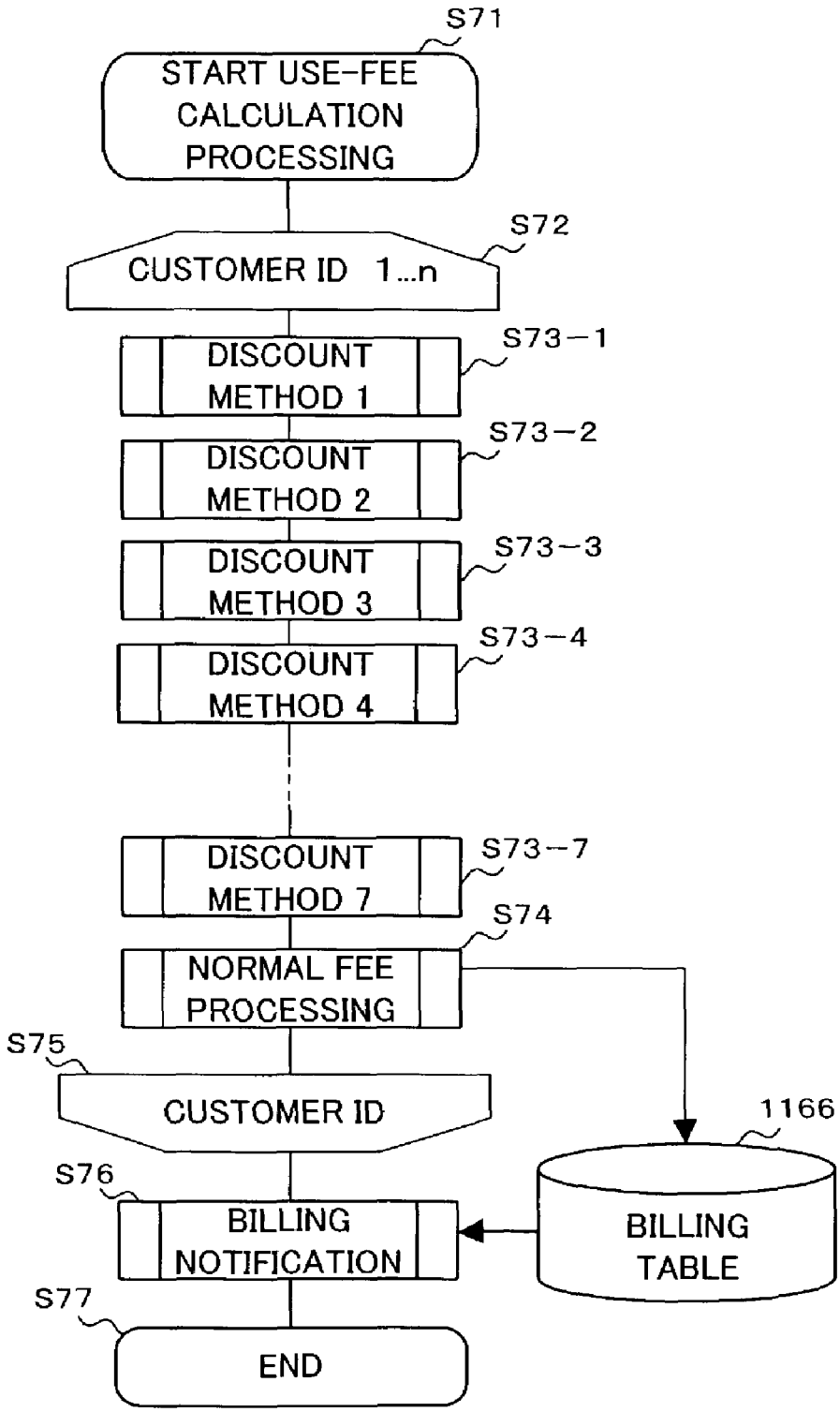
FIG. 20 is a flowchart of a sequence of use-fee calculation processing in an embodiment of the present invention.

Further, it is possible to add processing for various types of discounts according to the status of use, to the use-fee calculation processing (S07). Hereinbelow, the use-fee calculation processing to which discount processing is added is explained. FIG. 20 is a flowchart of a sequence of the use-fee calculation processing in an embodiment of the present invention.

When the use-fee calculation processing is started (S71), loop processing in steps S72 to (S74) is repeated for the first to nth customers in turn by using the customer ID of each customer as a key. When the processing for the nth customer is completed, the operation goes to billing notification processing (S76). In the loop processing, discount methods 1 to 7 (S73-1 to S73-7) each realizing different discount processing are executed, and performs normal fee processing (S74), in which a fee is set by referring to the fee table 1163. Then, the calculated use fee is stored as billing information in a billing table 1166. Subsequently, in billing notification processing (S76), the billing information registered in the billing table 1166 is sent to a concerned party, and the processing of FIG. 20 is completed (S77).

There are various discount methods including the following examples:

(1) A discount method in which a fee for a copy in a company is fixed until the number of copies reaches a predetermined number.

(2) A discount method in which a user is exempted from billing when the user has paid a fee for a predetermined duration.

(3) A package discount method in which a discount is made when a plurality of predetermined files are purchased in a lump sum.

(4) A volume discount method in which a unit price for a file is discounted when an amount of use in an intranet exceeds a predetermined amount.

(5) A discount method in which a unit price of a file is discounted corresponding to continuous use.

(6) A discount method in which a unit price of a newly purchased file is discounted corresponding to continuous use.

(7) A discount method in which a discount is made when a predetermined time elapses from a production date or sale start date of a file.

Concrete examples of three of the above discount methods (1) to (7) are explained below. In the following concrete examples, the discount method 1 corresponds to the above discount method (1), the discount method 2 corresponds to the above discount method (5), and the discount method 3 corresponds to the above discount method (4).

Figure 21:
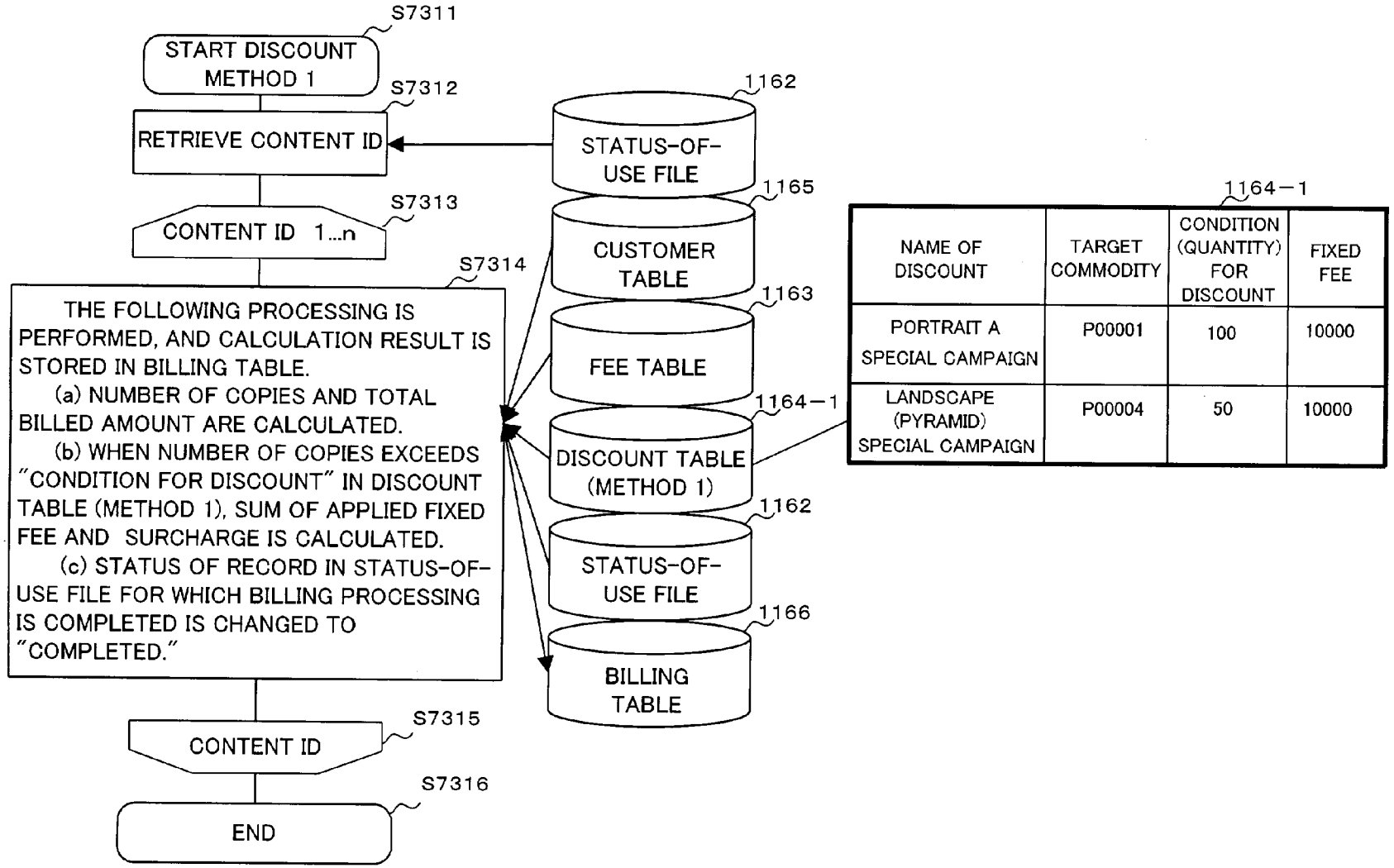
FIG. 21 is a flowchart of a sequence of a discount method 1 in the use-fee calculation processing in an embodiment of the present invention.

First, the discount method 1 is explained. FIG. 21 is a flowchart of a sequence of the discount method 1 in the use-fee calculation processing in an embodiment of the present invention.

When the discount method 1 is started (S7311), content IDs of a predetermined customer are retrieved from the status-of-use file 1162 (S7312). Then, loop processing in steps S7313 to S7315 is repeated for the first to nth content IDs in turn by using each content ID as a key. When the processing for the nth content ID is completed, the sequence of FIG. 21 is completed (S7316). At this time, discount processing (S7314) is performed by referring to a discount table 1164-1 for the discount method 1, where conditions for discounts are indicated in the discount table 1164-1. Specifically, names of the discounts, target commodities, and the conditions for the discounts are set in the discount table 1164-1, where the conditions for the discounts include quantities based on which discounts are made and discounted fixed fees. The discount processing (S7314) includes the following operations.

(a) The number of copies of target content is calculated, and a total billed amount is obtained.

(b) The number of copies and the "conditions for discounts" in the discount table 1164-1 (for the discount method 1) are compared. When the number of copies is within a range set in the "conditions for discounts," the fixed fee is applied. When the number of copies exceeds the range set in the "conditions for discounts," a sum of the applied fixed fee and a surcharge is obtained, and then a use fee is calculated. The calculated use fee is stored in the billing table 1166 of target customers retrieved based on a customer table 1165 in which content and customers are associated with each other.

(c) The status of a record in the status-of-use file 1162 for which the billing processing is completed is changed to "completed."

Figure 22:
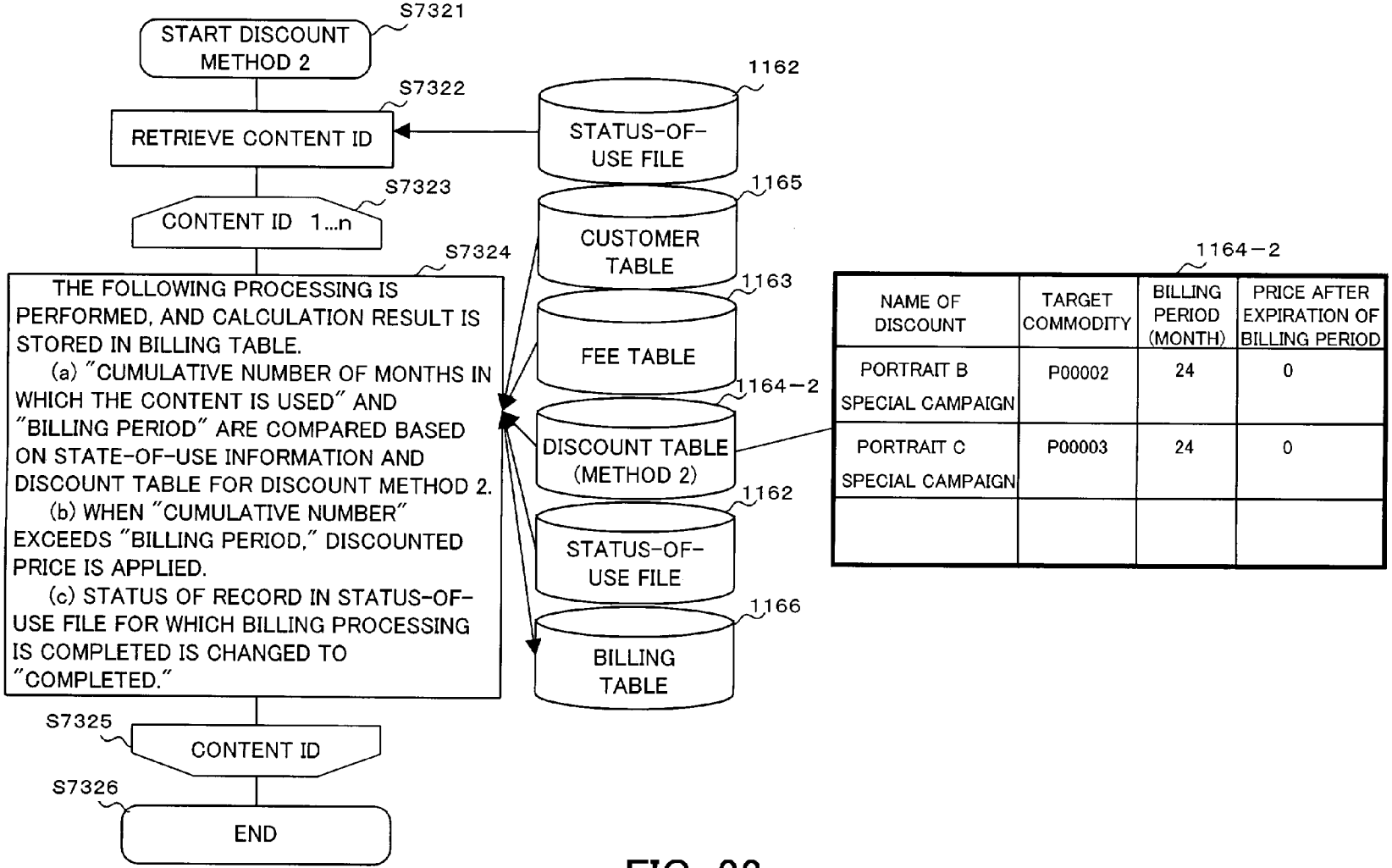
FIG. 22 is a flowchart of a sequence of a discount method 2 in the use-fee calculation processing in an embodiment of the present invention.

Next, the discount method 2 is explained. FIG. 22 is a flowchart of a sequence of the discount method 2 in the use-fee calculation processing in an embodiment of the present invention.

When the discount method 2 is started (S7321), content IDs of a predetermined customer are retrieved from the status-of-use file 1162 (S7322). Then, loop processing in steps S7323 to S7325 is repeated for the first to nth content IDs in turn by using each content ID as a key. When the processing for the nth content ID is completed, the sequence of FIG. 22 is completed (S7326). At this time, discount processing (S7324) is performed by referring to a discount table 1164-2 for the discount method 2, where conditions for discounts are indicated in the discount table 1164-2. Specifically, names of the discounts, target commodities, and the conditions for the discounts are set in the discount table 1164-2, where the conditions for the discounts include billing periods during which fees are charged and prices after expiration of the billing periods. The discount processing (S7324) includes the following operations.

(a) The "cumulative number of months in which the content is used" and the "billing period" are compared based on the state-of-use information and the discount table 1164-2 for the discount method 2.

(b) When the "cumulative number of months in which the content is used" exceeds the "billing period," a discounted price is applied and a use fee is calculated. The calculated use fee is stored in the billing table 1166 of target customers retrieved based on the customer table 1165.

(c) The status of a record in the status-of-use file 1162 for which the billing processing is completed is changed to "completed."

Figure 23:
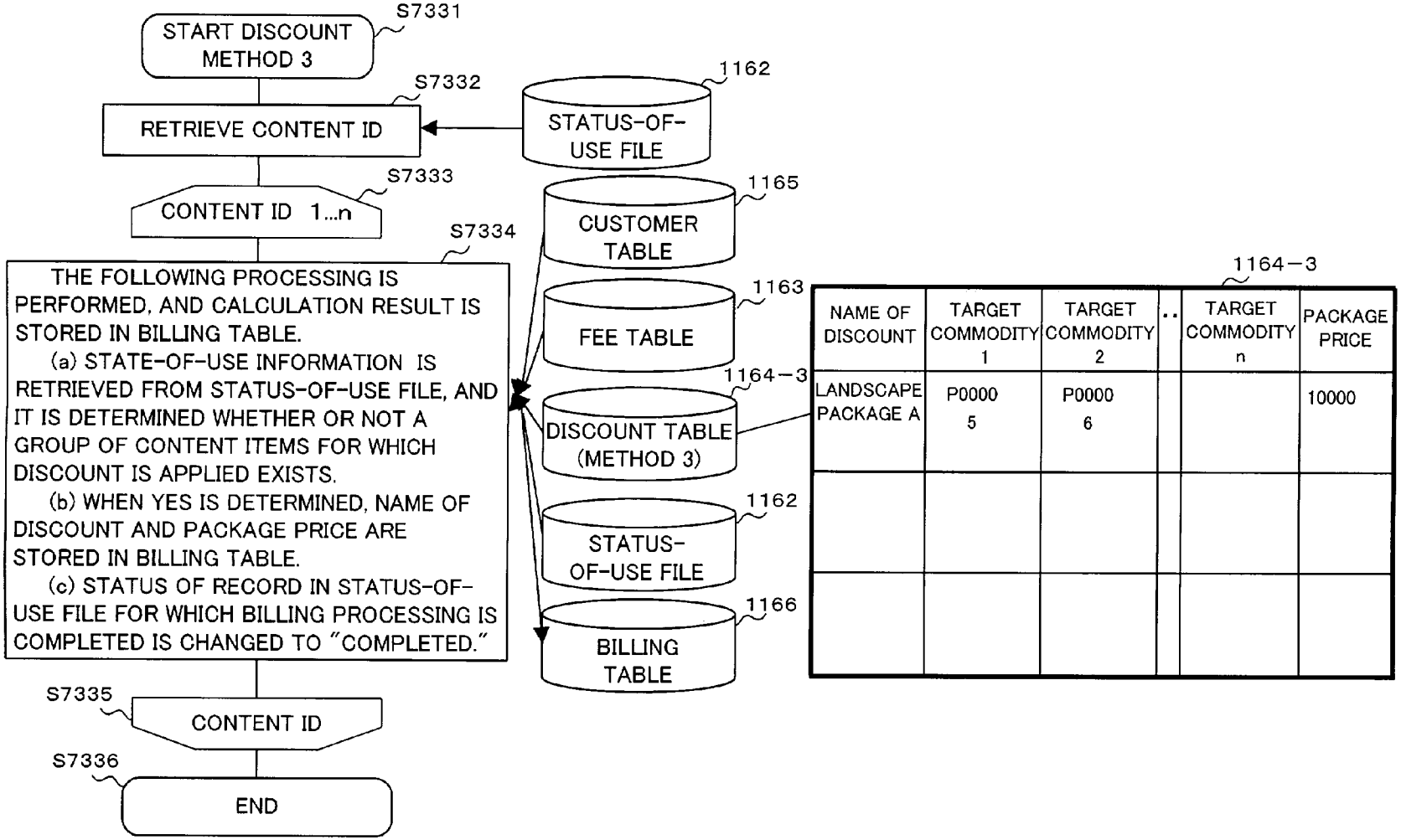
FIG. 23 is a flowchart of a sequence of a discount method 3 in the use-fee calculation processing in an embodiment of the present invention.

Finally, the discount method 3 is explained. FIG. 23 is a flowchart of a sequence of the discount method 3 in the use-fee calculation processing in an embodiment of the present invention.

When the discount method 3 is started (S7331), content IDs of a predetermined customer are retrieved from the status-of-use file 1162 (S7332). Then, loop processing in steps S7333 to S7335 is repeated for the first to nth content IDs in turn by using each content ID as a key. When the processing for the nth content ID is completed, the sequence of FIG. 23 is completed (S7336). At this time, discount processing (S7334) is performed by referring to a discount table 1164-3 for the discount method 3, where conditions for discounts are indicated in the discount table 1164-3. Specifically, names of the discounts, groups of target commodities, and package prices of the respective groups of target commodities are set in the discount table 1164-3. The discount processing (S7334) includes the following operations.

(a) The state-of-use information is retrieved from the status-of-use file 1162, and it is determined whether or not a group of content items for which a discount is applied exists.

(b) When a group of content items for which a discount is applied exists, the names of the discounts and a package price are stored in the billing table 1166 of target customers retrieved based on the customer table 1165.

(c) The status of a record in the status-of-use file 1162 for which the billing processing is completed is changed to "completed."

According to the above sequences, a final use fee obtained after the discount processing is stored in the billing table 1166. FIG. 24 is a diagram illustrating an example of the billing table associated with the present invention. In the billing table 1166, a billing date, a commodity code, a commodity name, and a billed amount are registered for each customer ID.

As explained above, according to the present invention, the actual situation of use of content can be recognized. Therefore, it is possible to calculate a use fee by using various types of discount methods according to the status of use.

Two concrete examples of the use-fee calculation processing are explained below.

In the first concrete example, an image content item is purchased, copied in a company when necessary, and removed when the image content item becomes unnecessary. It is assumed that the price of an image sold by a sales company through a network is 50 yen per month, 50 yen per month is charged for one of a plurality of identical images, and 40 yen per month is charged for each of the other of the plurality of identical images since each of the other of the plurality of identical images is deemed to be a copy of the one of the plurality of identical images.

When a user downloads an image A from a network, and produces a copy A' of the image A, a search robot (monitoring apparatus) which makes the rounds of the network at regular time intervals detects the images A and A'. Since it is possible to recognize that the image A' is a copy of the image A by referring to the billing table, the use fee for one month use of the images is 90 yen, which is a sum of 50 yen for the image A and 40 yen for the copy of the image A'.

Thereafter, when the copy A' is removed, the search robot recognizes that only the image A exists. Therefore, only 50 yen per month is charged for the one image.

When an image A is purchased from a conventional network, the purchase of the image A can be identified only at the time of download of the image A. Therefore, it is necessary to pay a relatively high price in anticipation of use for a predetermined duration, or pay a fixed fee every month, for each image. In addition, there is no arrangement for recognizing a copy of an image in the conventional network. Therefore, for example, it is impossible to set a discounted fee for the copy image which is added later or bill for the copy image. Thus, for example, in the above case where the images A and A' exists, billing for the copy image A' is impossible. Alternatively, a use fee of 100 yen per month, corresponding to the use fee for the image A downloaded twice, is charged.

However, according to the present invention, it is possible to recognize an image and a copy of the image, and determine one of the identical images to be a copy. Therefore, in the above case where the images A and A' exist, only 90 yen is required to be paid as a use fee. In addition, since the duration in which the image is used can be calculated automatically and accurately by the search robot, the user is required to pay a fee for only the duration in which the image is actually used. Further, even when the use is terminated, the user is not required to request termination of payment.

In the second concrete example, it is assumed that no fee is charged for use of software sold by a sales company through a network for a duration shorter than one month, and the software can be used at no charge after payment of a use fee for one year.

When a user purchases software from a network, starts use of the software, decides to terminate the use of the software after use for two months, and deletes the software from the disk, a search robot which makes the rounds of the network determines the duration of the use based on status-of-use data, and charges a use fee for the use for two months since the duration of the use is longer than one month.

When a user purchases software from a conventional network, the user is required to pay in a lump sum. In addition, when use of content during a trial period is allowed at no charge, it is difficult for sellers to surely charge a use fee from a user who continuously use of the content. Therefore, in the conventional network, the software having only limited functions is distributed for trial use.

However, according to the present invention, the search robot makes the rounds of the network, and sellers can properly charge for use of software according to the duration of the use. Therefore, users can use all functions of the software for a trial, and continuous use after the trial use becomes easier.

The use fee (e.g., a billing log) calculated as above is sent by the billing notification means 1150 in the digital content sales company 1000 to a person in charge of billing processing or the like.

Although the status of use is recognized by the content billing apparatus 1100 in the digital content sales company 1000 in the above explanations, it is possible that the recognition of the status of use may be included in the operations performed by the monitoring apparatus 2100 in the user company 2000.

The above processing functions can be realized by a server computer and a client computer. In this case, a server program and a client program are provided, where the server program describes details of processing realizing the functions which the content billing apparatus should have, and the client program describes details of processing realizing the functions which the monitoring apparatus should have. When the server computer executes the server program, the processing functions of the content billing apparatus are realized on the server computer. In addition, when the client computer executes the client program, the processing functions of the monitoring apparatus are realized on the client computer.

The server program and the client program each describing the details of processing can be stored in a computer-readable recording mediums. The computer-readable recording mediums may be a magnetic recording device, an optical disk, an optical magnetic recording medium, a semiconductor memory, or the like. The magnetic recording device may be a hard disk drive (HDD), a flexible disk (FD), a magnetic tape, or the like. The optical disk may be a DVD (Digital Versatile Disk), a DVD-RAM (Random Access Memory), a CD-ROM (Compact Disk Read Only Memory), a CD-R (Recordable)/RW (ReWritable), or the like. The optical magnetic recording medium may be an MO (Magneto-Optical Disk) or the like.

In order to put the server program and the client program into the market, for example, it is possible to sell a portable recording medium such as a DVD or a CD-ROM in which each program is recorded. Alternatively, the client program can be stored in a storage device belonging to a server computer, and transferred from the server computer to the client computer through a network.

The server computer which executes the server program stores the server program in a storage device belonging to the server computer. For example, the server program is originally recorded in a portable recording medium. Then, the server computer reads the server program from the storage device, and performs processing in accordance with the server program. Alternatively, the server computer may directly read the server program from the portable recording medium for performing processing in accordance with the server program.

The client computer which executes the client program stores the client program in a storage device belonging to the client computer. For example, the client program is originally recorded in a portable recording medium, or transferred from the server computer. Then, the client computer reads the client program from the storage device, and performs processing in accordance with the client program. Alternatively, the client computer may directly read the client program from the portable recording medium for performing processing in accordance with the client program. Further, the client computer may sequentially perform processing in accordance with each portion of the client program when the client computer receives the portion of the client program from the server computer.

As explained above, according to the present invention, the monitoring apparatus is arranged in a predetermined communication network, and monitors a status of use of digital content at predetermined search intervals, and the content billing apparatus performs billing processing based on use information generated by the monitoring apparatus or comparison data of the use information. Therefore, it is possible to protect copyrights of digital content, and charge a proper use fee based on an actual situation of use of the digital content. In addition, in order to calculate the use fee corresponding to the actual situation of use of the digital content, it is possible to flexibly charge for use according to the duration and amount of the use, and perform billing processing including various types of discounts.

Further, since users of digital content are required to pay a fee corresponding to only the amount of actual use, it is possible to avoid needless expense. Furthermore, since the monitoring apparatus automatically monitors copying and in-company delivery of digital content, and calculates use fees for the copying and in-company delivery, it is possible to reduce the operations for obtaining various types of permission which are required at the time of copying or in-company delivery of a new copy.

The foregoing is considered as illustrative only of the principle of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A content billing method for performing billing processing for digital content in which identification information is embedded by using a digital watermarking technique on a computer, comprising the steps of:

(a) searching for a plurality of digital content items, and collecting information on whether or not the plurality of digital content items exist;

(b) extracting identification information embedded in advance in the plurality of digital content items, and generating and recording use information on the plurality of digital content items based on the identification information;

(c) recognizing a status of use in a predetermined period based on comparison of the newest use information and older use information which is recorded, and generating state-of-use information, when a digital content item having first identification information identical to second identification information of a previously detected digital content item is newly detected, the newly detected digital content item is determined to be a copy of the previously detected digital content item; and (d) calculating a use fee for digital content according to the state-of-use information and referring to a fee table provided for each digital content item and calculating a use fee corresponding to the copy.

2. The content billing method according to claim 1, wherein the operation in step (a) is performed at predetermined intervals which are preset, or at a predetermined date geared to a calendar.

3. The content billing method according to claim 1, wherein the operation in step (a) is performed at random period based on random setting by a random-period generation means in a predetermined period including a day, a week, and a month.

4. The content billing method according to claim 1, wherein in step (a), a computer as a target of a search is selected based on a target-of-search file in which at least one target of the search is preset, and only the selected computer is searched.

5. The content billing method according to claim 1, wherein in step (c), the newest use information and the older use information are compared, and state-of-use information on a digital content item for which a difference occurs is generated, and in step (d), a fee table provided for each digital content item is referred to, and a use fee corresponding to the difference is calculated.

6. The content billing method according to claim 1, wherein in step (c), the newest use information and the older use information are compared, and a duration of use is recognized by determining whether use of a digital content item is newly started, completed, or continued, and in step (d), a use fee corresponding to the duration of use is calculated.

7. The content billing method according to claim 1, wherein in step (d), it is determined whether or not the status of use based on the state-of-use information matches with a condition for a discount which is preset in discount-setting information, and the use fee is calculated in accordance with a discount rate set in the discount-setting information when the status of use matches with the condition.

8. A content billing system for performing billing processing for digital content in which identification information is embedded by using a digital watermarking technique, comprising:

a monitoring apparatus including, automatic-search-and-collection means which searches for at least one predetermined digital content item existing in at least one computer connected to a predetermined communication network, and collects information on whether or not the at least one predetermined digital content item exists, search management means which manages a predetermined search period which is preset, and activates the automatic-search-and-collection means when the predetermined search period expires, and identification-information recognition means which extracts identification information embedded in advance in the at least one predetermined digital content item which is searched for by the automatic-search-and-collection means, and generates use information on the at least one predetermined digital content item based on the identification information; and a content billing apparatus being connected to the monitoring apparatus through the communication network and including, use-information management means which acquires the use information through the communication network, records the acquired use information in a predetermined storage device, and manages the stored use information, status-of-use recognition means which recognizes a status of use in a predetermined period based on comparison of use information which is newly recorded and older use information which is recorded in the predetermined storage device for each predetermined section, and generates state-of-use information, when a digital content item having first identification information identical to second identification information of a previously detected digital content item is newly detected, the newly detected digital content item is determined to be a copy of the previously detected digital content item; and use-fee calculation means which calculates a use fee for digital content according to the state-of-use information and referring to a fee table provided for each digital content item and calculating a use fee corresponding to the copy.

9. A content billing apparatus for performing billing processing for digital content in which identification information is embedded by using a digital watermarking technique, comprising:

use-information management means which acquires use information on at least one predetermined digital content item used in a predetermined communication network and detected based on identification information embedded in advance in the at least one predetermined digital content item, records the acquired use information in a predetermined storage device, and manages the stored use information;

status-of-use recognition means which recognizes a status of use in a predetermined period based on comparison of use information which is newly recorded and older use information which is recorded in the predetermined storage device for each predetermined section, and generates state-of-use information, when a digital content item having first identification information identical to second identification information of a previously detected digital content item is newly detected, the newly detected digital content item is determined to be a copy of the previously detected digital content item; and use-fee calculation means which calculates a use fee for digital content according to the state-of-use information and referring to a fee table provided for each digital content item and calculating a use fee corresponding to the copy.

* * * * *